US008694174B2

(12) United States Patent
Nishino et al.

(10) Patent No.: US 8,694,174 B2
(45) Date of Patent: Apr. 8, 2014

(54) ENERGY SAVING SUPPORT DEVICE

(75) Inventors: Atsushi Nishino, Kusatsu (JP); Satoshi Hashimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 362 days.

(21) Appl. No.: 13/122,528

(22) PCT Filed: Oct. 6, 2009

(86) PCT No.: PCT/JP2009/005179

§ 371 (c)(1),
(2), (4) Date: Apr. 4, 2011

(87) PCT Pub. No.: WO2010/041424

PCT Pub. Date: Apr. 15, 2010

(65) Prior Publication Data

US 2011/0190954 A1 Aug. 4, 2011

(30) Foreign Application Priority Data

Oct. 9, 2008 (JP) ..... 2008-263219
Sep. 17, 2009 (JP) ..... 2009-215411

(51) Int. Cl.
*G05B 1/01* (2006.01)

(52) U.S. Cl.
USPC ..... 700/291; 700/276

(58) Field of Classification Search
USPC ..... 700/276, 291, 295
See application file for complete search history.

(56) References Cited

U.S. PATENT DOCUMENTS 6,983,210 B2 * 1/2006 Matsubayashi et al. ..... 702/60
2006/0065750 A1 * 3/2006 Fairless ..... 236/46 R

FOREIGN PATENT DOCUMENTS

JP 57-91039 U 11/1980
JP 2001-99465 A 4/2001
JP 2002-2156 A 1/2002
JP 2003-216715 A 7/2003
JP 2004-85087 A 3/2004
JP 2006-292279 A 10/2006
JP 2008-157533 A 7/2008
WO WO 2008/088031 A1 7/2008

OTHER PUBLICATIONS

International Preliminary Report of corresponding PCT Application No. PCT/JP2009/005179.
International Search Report of corresponding PCT Application No. PCT/JP2009/005179.

* cited by examiner

*Primary Examiner* — Charles Kasenge
(74) *Attorney, Agent, or Firm* — Global IP Counselors

(57) ABSTRACT

An energy saving support device supports energy saving of an air conditioner and includes an acquiring unit, a first energy calculating unit, a second energy calculating unit, an information generating unit and a reporting unit. The acquiring unit acquires operating data regarding the air conditioner. The first energy calculating unit determines a total consumed energy or a standard consumed energy of the air conditioner as a comparison target energy based on the operating data acquired by the acquiring unit. The second energy calculating unit determines a low-COP consumed energy based on the operating data acquired by the acquiring unit. The information generating unit generates room-for-energy-saving information in order to determine a potential for energy saving based on the comparison target energy and the low-COP consumed energy. The reporting unit reports the room-for-energy-saving information.

15 Claims, 23 Drawing Sheets

COOLING AND HEATING ENTHALPY DIFFERENCE
(MOLLIER DIAGRAM)

■ ··· DIFFERENCE BETWEEN STANDARD CONSUMED ENERGY AND LOW-COP CONSUMED ENERGY

□ ··· STANDARD CONSUMED ENERGY

POWER CONSUMPTION AT TIME OF LOW COP

PROPORTION OF POWER CONSUMPTION AT TIME OF LOW COP

| | CONSUMED ENERGY [MWh] | | STANDARD RATIO (%) |
|---|---|---|---|
| | TOTAL QUANTITY (STANDARD) | AT TIME OF LOW-COP OPERATION | |
| AIR CONDITIONER 10a | 0.5 | 0.01 | 2.0 |
| AIR CONDITIONER 10e | 0.8 | 0.2 | 25.0 |
| : | : | : | : |

| | CONSUMED ENERGY [MWh] | | STANDARD RATIO (%) |
|---|---|---|---|
| | TOTAL QUANTITY (STANDARD) | AT TIME OF LOW-COP OPERATION | |
| AIR CONDITIONER 10a | 8.6 | 0.7 | 8.1 |
| AIR CONDITIONER 10e | 1.5 | 0.8 | 53.3 |
| ⋮ | ⋮ | ⋮ | ⋮ |

■ ···LOW-COP INFORMATION (LOW-COP CONSUMED ENERGY)

▨ ···HIGH-COP INFORMATION (HIGH-COP CONSUMED ENERGY)

p10

| AIR CONDITIONER NAME | INSTALLATION LOCATION | LOW-COP CONSUMED ENERGY | TOTAL CONSUMED ENERGY |
|---|---|---|---|
| 10e | WEST OFFICE | 175kWh | 250kWh |
| 10g | NORTH OFFICE | 160kWh | 175kWh |
| 10j | EAST OFFICE | 151kWh | 215kWh |
| 10a | SOUTH OFFICE | 140kWh | 265kWh |
| 10m | CONFERENCE ROOM 1 | 116kWh | 116kWh |
| 10i | CONFERENCE ROOM 2 | 103kWh | 125kWh |
| ⋮ | ⋮ | ⋮ | |

FIG. 22

ENERGY SAVING SUPPORT DEVICE

CROSS-REFERENCE TO RELATED APPLICATIONS

This U.S. National stage application claims priority under 35 U.S.C. §119(a) to Japanese Patent Application Nos. 2008-263219 and 2009-215411, filed in Japan on Oct. 9, 2008 and Sep. 17, 2009, the entire contents of which are hereby incorporated herein by reference.

TECHNICAL FIELD

The present invention relates to an energy saving support device and particularly an energy saving support device that supports energy saving of air conditioners.

BACKGROUND ART

In buildings and so forth occupied by multiple offices or multiple tenants, so-called split system air conditioners are often used to effectively regulate the air-conditioned environments inside the building. In split system air conditioners, multiple air conditioners are installed inside a building, so in a building in which split system air conditioners are used, the proportion of the consumed energy of the air conditioners with respect to the consumed energy of the building overall tends to increase as the number of air conditioners installed increases.

Meanwhile, in recent years, reducing consumed energy has been raised. For example, as described in Japanese Patent Publication No. 2004-85087, a technology that estimates the consumed energy of an air conditioner and judges from the estimation result whether or not there is waste in the operation of the air conditioner is known.

SUMMARY

Technical Problem

Incidentally, in recent years, in order to more effectively regulate air-conditioned environments, there are cases where multiple air conditioners are divided into multiple systems, such as by room or by tenant, for example, inside one building. In this case, the way in which each air conditioner is utilized differs, so it ends up becoming difficult for the manager of the building, for example, to grasp which air conditioner should have its consumed energy reduced.

Therefore, it is an object of the present invention to provide an energy saving support device that enables the manager of a building to grasp information relating to the consumed energies of air conditioners (for example, which air conditioner should have its consumed energy reduced).

Solution to the Problem

An energy saving support device pertaining to a first aspect of the invention is a device that supports energy saving of an air conditioner. The energy saving support device comprises an acquiring unit, a first energy calculating unit, a second energy calculating unit, an information generating unit, and a reporting unit. The acquiring unit acquires operating data regarding the air conditioner. The first energy calculating unit obtains, on the basis of the operating data that the acquiring unit has acquired, a total consumed energy or a standard consumed energy of the air conditioner as a comparison target energy. The second energy calculating unit obtains, on the basis of the operating data that the acquiring unit has acquired, a low-COP consumed energy. The low-COP consumed energy is an energy that the air conditioner consumed at a time when it was operating at a COP equal to or less than a predetermined value. The information generating unit generates, on the basis of the comparison target energy and the low-COP consumed energy, room-for-energy-saving information for judging whether there is a lot of or little room for energy saving. The reporting unit reports the room-for-energy-saving information.

According to this energy saving support device, the room-for-energy-saving information is generated and reported on the basis of the comparison target energy and the low-COP consumed energy. Here, examples of the room-for-energy-saving information may include the proportion of the low-COP consumed energy with respect to the total consumed energy and the difference between the standard consumed energy and the low-COP consumed energy. Because of this room-for-energy-saving information, that is, information relating to the consumed energy of the air conditioner, the user can easily grasp the air conditioner in which there is room for energy saving. Consequently, the user can take measures to reduce consumed energy with respect to the air conditioner judged as having a lot of room for energy saving.

An energy saving support device pertaining to a second aspect of the invention is the energy saving support device pertaining to the first aspect of the invention, wherein the room-for-energy-saving information is the proportion of the low-COP consumed energy with respect to the total consumed energy.

According to this energy saving support device, the proportion of the low-COP consumed energy with respect to the total consumed energy is reported as the room-for-energy-saving information. Because of this, the user can know to what extent the air conditioner is performing an operation with poor efficiency, so the user can grasp how much room there is in which consumed energy can be reduced with respect to the total consumed energy.

An energy saving support device pertaining to a third aspect of the invention is the energy saving support device pertaining to the second aspect of the invention, wherein the room-for-energy-saving information is information in which the low-COP consumed energy is expressed as a percent in a case where the total consumed energy is 100%.

According to this energy saving support device, the low-COP consumed energy with respect to the total consumed energy is expressed as a percent, so the user can easily grasp how often the air conditioner is performing an operation with poor efficiency.

An energy saving support device pertaining to a fourth aspect of the invention is the energy saving support device pertaining to the first aspect of the invention, wherein the standard consumed energy is an energy that would have been consumed in a case assuming that the COP of the air conditioner had been a predetermined value in the time when the air conditioner was operating at a COP equal to or less than a predetermined value. Additionally, the room-for-energy-saving information is the difference between the standard consumed energy and the low-COP consumed energy.

According to this energy saving support device, the difference between the low-COP consumed energy that was actually consumed at a time when the air conditioner was operating at a COP equal to or less than a predetermined value and the energy (that is, the standard consumed energy) inferred to have been consumed if the COP had been the predetermined value at this time is reported as an index of room for energy saving. Because of this, the user can know to what extent the air conditioner is performing an operation with poor efficiency, so the user can specifically grasp how much room there is in which consumed energy can be reduced.

An energy saving support device pertaining to a fifth aspect of the invention is the energy saving support device pertaining to the first aspect of the invention, wherein the room-for-energy-saving information is information comprising an absolute quantity of the total consumed energy and an absolute quantity of the low-COP consumed energy. The reporting unit displays the room-for-energy-saving information such that the absolute quantity of the total consumed energy and the absolute quantity of the low-COP consumed energy relating to the air conditioner are visually graspable.

According to this energy saving support device, the user can visually grasp to what extent the air conditioner is performing an operation with poor efficiency from the absolute quantity of the low-COP consumed energy and the absolute quantity of the total consumed energy that are displayed.

An energy saving support device pertaining to a sixth aspect of the invention is the energy saving support device pertaining to any of the first to fifth aspects of the invention, wherein the acquiring unit acquires, from a plurality of the air conditioners, the operating data of each of the air conditioners. The first energy calculating unit and the second energy calculating unit calculate the comparison target energy and the low-COP consumed energy for each of the air conditioners. The information generating unit generates the room-for-energy-saving information for each of the air conditioners. Additionally, the reporting unit comparably displays the room-for-energy-saving information of each of the air conditioners.

According to this energy saving support device, the room-for-energy-saving information in each of the plural air conditioners is comparably displayed. For that reason, the user can know at once room for energy saving there is in each air conditioner. Consequently, the user can compare the extent of room for energy saving in each air conditioner, assign priority in descending order of the room for energy saving, for example, and perform measures to reduce consumed energy.

An energy saving support device pertaining to a seventh aspect of the invention is the energy saving support device pertaining to the sixth aspect of the invention, wherein the reporting unit displays the room-for-energy-saving information of the plurality of the air conditioners inside one diagram or table in order beginning with the room-for-energy-saving information in which the low-COP consumed energy is large.

According to this energy saving support device, the user can know at once, from the room-for-energy-saving information being displayed in descending order of the low-COP consumed energy, which air conditioner of all of the air conditioners has the worst efficiency and which air conditioner of all of the air conditioners has the best efficiency. Consequently, the user can easily judge beginning with which air conditioner an energy-saving measure would best be performed in order.

An energy saving support device pertaining to an eighth aspect of the invention is the energy saving support device pertaining to the sixth or seventh aspect of the invention, wherein the reporting unit selectably displays the room-for-energy-saving information of the plurality of the air conditioners inside one diagram or table. In a case where the room-for-energy-saving information has been selected, the reporting unit displays in a time series an absolute quantity of the low-COP consumed energy and an absolute quantity of the total consumed energy regarding the air conditioner corresponding to the room-for-energy-saving information that has been selected.

For example, let it be assumed that the room-for-energy-saving information of each air conditioner is being displayed by month. When arbitrary room-for-energy-saving information is selected from among this, the low-COP consumed energy and the total consumed energy (both absolute quantities) regarding the air conditioner corresponding to the room-for-energy-saving information becomes displayed by day. That is, the detailed content of the selected room-for-energy-saving information is displayed more finely in a time series. Because of this, the user can grasp in detail at what point in time an operation with poor efficiency was performed and can take appropriate measures for reducing consumed energy.

An energy saving support device pertaining to a ninth aspect of the invention is the energy saving support device pertaining to any of the sixth to eighth aspects of the invention, wherein the acquiring unit acquires the operating data from the plurality of the air conditioners which are installed inside one air conditioning target space.

Here, the plural air conditioners are installed inside one air conditioning target space. According to this energy saving support device, the user can know the room for energy saving in each air conditioner inside the one air conditioning target space and can take measures to reduce consumed energy while considering the temperature inside the air conditioning target space and airflow balance.

An energy saving support device pertaining to a tenth aspect of the invention is the energy saving support device pertaining to any of the first to ninth aspects of the invention, wherein the reporting unit displays the room-for-energy-saving information together with information relating to date and time.

According to this energy saving support device, the room-for-energy-saving information is displayed together with information relating to date and time. Because of this, the user can know when the air conditioner performed an operation with poor efficiency.

An energy saving support device pertaining to an eleventh aspect of the invention is the energy saving support device pertaining to any of the first to ninth aspects of the invention, wherein the reporting unit displays the room-for-energy-saving information together with information relating to outside air temperature.

According to this energy saving support device, the room-for-energy-saving information is displayed together with information relating to outside air temperature. Because of this, the user can know in what environmental conditions the efficiency of the air conditioner went down.

An energy saving support device pertaining to a twelfth aspect of the invention is the energy saving support device pertaining to any of the first to eleventh aspects of the invention, further comprising a third energy calculating unit. The third energy calculating unit obtains a high-COP consumed energy. The high-COP consumed energy is an energy that the air conditioner consumed at a time when it was operating at a COP equal to or greater than the predetermined value. The information generating unit further generates the room-for-energy-saving information on the basis of the high-COP consumed energy.

According to this energy saving support device, the room-for-energy-saving information further generated on the basis of the high-COP consumed energy and not just the low-COP consumed energy is reported. Because of this, the user can not only know the air conditioner that is performing an operation with poor efficiency but can also know the air conditioner that is performing an operation with good efficiency focusing on the high-COP consumed energy.

An energy saving support device pertaining to a thirteenth aspect of the invention is the energy saving support device pertaining to the twelfth aspect of the invention, wherein the room-for-energy-saving information includes low-COP information relating to the low-COP consumed energy and high-COP information relating to the high-COP consumed energy. The reporting unit displays the low-COP information and the high-COP information such that they are visually distinguishable.

Examples of the low-COP information may include the proportion of the low-COP consumed energy with respect to the total consumed energy and the low-COP consumed energy itself (that is, its absolute quantity). Examples of the high-COP information may include the proportion of the high-COP consumed energy with respect to the total consumed energy and the high-COP consumed energy itself (that is, its absolute quantity). According to this energy saving support device, the low-COP information and the high-COP information are displayed such that they are visually distinguishable, so the user can instantly and easily know the good and bad of the efficiency of the operation of each air conditioner.

An energy saving support device pertaining to a fourteenth aspect of the invention is the energy saving support device pertaining to the twelfth aspect of the invention, wherein the room-for-energy-saving information includes low-COP information relating to the low-COP consumed energy and high-COP information relating to the high-COP consumed energy. The reporting unit is further capable of displaying display selection information. The display selection information is information for selecting which of the low-COP information and the high-COP information to display. The reporting unit displays only the low-COP information of the room-for-energy-saving information in a case where display of the low-COP information has been selected in the display selection information. Further, the reporting unit displays only the high-COP information of the room-for-energy-saving information in a case where display of the high-COP information has been selected in the display selection information.

According to this energy saving support device, only the low-COP information is displayed if display of the low-COP information is selected and only the high-COP information is displayed if display of the high-COP information is selected. Consequently, the user can set which of the low-COP information and the high-COP information to display according to preference and object.

An energy saving support device pertaining to a fifteenth aspect of the invention is a device that supports energy saving of an air conditioner. The energy saving support device comprises an acquiring unit, a comparison energy calculating unit, a COP energy calculating unit, an information generating unit, and a reporting unit. The acquiring unit acquires operating data regarding the air conditioner. The comparison energy calculating unit obtains, on the basis of the operating data that the acquiring unit has acquired, a total consumed energy or a standard consumed energy of the air conditioner as a comparison target energy. The COP energy calculating unit obtains, on the basis of the operating data that the acquiring unit has acquired, at least one of a high-COP consumed energy and a low-COP consumed energy. The high-COP consumed energy is an energy that the air conditioner consumed at a time when it was operating at a COP equal to or greater than a predetermined value. The low-COP consumed energy is an energy that the air conditioner consumed at a time when it was operating at a COP equal to or less than the predetermined value. The information generating unit generates, on the basis of the calculation result by the COP energy calculating unit and the calculation result of the comparison energy calculating unit, room-for-energy-saving information. The room-for-energy-saving information is information for judging whether there is a lot of or little room for energy saving. The reporting unit reports the room-for-energy-saving information.

According to this energy saving support device, the room-for-energy-saving information is generated and reported on the basis of the comparison target energy and at least one of the low-COP consumed energy and the high-COP consumed energy. Here, examples of the room-for-energy-saving information may include the proportion of the low-COP consumed energy with respect to the total consumed energy, the proportion of the high-COP consumed energy with respect to the total consumed energy, and the difference between the standard consumed energy and the low-COP consumed energy. Because of this room-for-energy-saving information, that is, information relating to the consumed energy of the air conditioner, the user can grasp the air conditioner in which there is room for energy saving. In particular, in a case where the room-for-energy-saving information has been generated on the basis of the high-COP consumed energy, the user can know the air conditioner that is performing an operation with good efficiency.

Advantageous Effects of the Invention

According to the energy saving support device pertaining to the first aspect of the invention, the user can easily grasp the air conditioner in which there is room for energy saving. Consequently, the user can take measures to reduce consumed energy with respect to the air conditioner judged as having a lot of room for energy saving.

According to the energy saving support device pertaining to the second aspect of the invention, the user can know to what extent the air conditioner is performing an operation with poor efficiency, so the user can grasp how much room there is in which consumed energy can be reduced with respect to the total consumed energy.

According to the energy saving support device pertaining to the third aspect of the invention, the user can easily grasp how often the air conditioner is performing an operation with poor efficiency.

According to the energy saving support device pertaining to the fourth aspect of the invention, the user can know to what extent the air conditioner is performing an operation with poor efficiency, so the user can specifically grasp how much room there is in which consumed energy can be reduced.

According to the energy saving support device pertaining to the fifth aspect of the invention, the user can visually grasp to what extent the air conditioner is performing an operation with poor efficiency.

According to the energy saving support device pertaining to the sixth aspect of the invention, the user can compare the extent of room for energy saving in each air conditioner, assign priority in descending order of the room for energy saving, for example, and perform measures to reduce consumed energy.

According to the energy saving support device pertaining to the seventh aspect of the invention, the user can easily judge beginning with which air conditioner an energy-saving measure would best be performed in order.

According to the energy saving support device pertaining to the eighth aspect of the invention, the user can grasp in detail at what point in time an operation with poor efficiency was performed and can take appropriate measures for reducing consumed energy.

According to the energy saving support device pertaining to the ninth aspect of the invention, the user can know the room for energy saving in each air conditioner inside the one air conditioning target space and can take measures to reduce consumed energy while considering the temperature inside the air conditioning target space and airflow balance.

According to the energy saving support device pertaining to the tenth aspect of the invention, the user can know when the air conditioner performed an operation with poor efficiency.

According to the energy saving support device pertaining to the eleventh aspect of the invention, the user can know in what environmental conditions the efficiency of the air conditioner went down.

According to the energy saving support device pertaining to the twelfth aspect of the invention, the user can not only know the air conditioner that is performing an operation with poor efficiency but can also know the air conditioner that is performing an operation with good efficiency focusing on the high-COP consumed energy.

According to the energy saving support device pertaining to the thirteenth aspect of the invention, the user can instantly and easily know the good and bad of the efficiency of the operation of each air conditioner.

According to the energy saving support device pertaining to the fourteenth aspect of the invention, the user can set which of the low-COP information and the high-COP information to display according to preference and object.

According to the energy saving support device pertaining to the fifteenth aspect of the invention, the user can grasp the air conditioner in which there is room for energy saving. In particular, in a case where the room-for-energy-saving information has been generated on the basis of the high-COP consumed energy, the user can know the air conditioner that is performing an operation with good efficiency.

BRIEF DESCRIPTION OF THE DRAWINGS

FIG. 22 is a diagram showing a case where all of the room-for-energy-saving information of the multiple air conditioners pertaining to FIG. 18 is displayed in one list.

DESCRIPTION OF EMBODIMENTS

An energy saving support device pertaining to the present invention will be described in detail below with reference to the drawings.

(1) Overall Configuration

Figure 1:
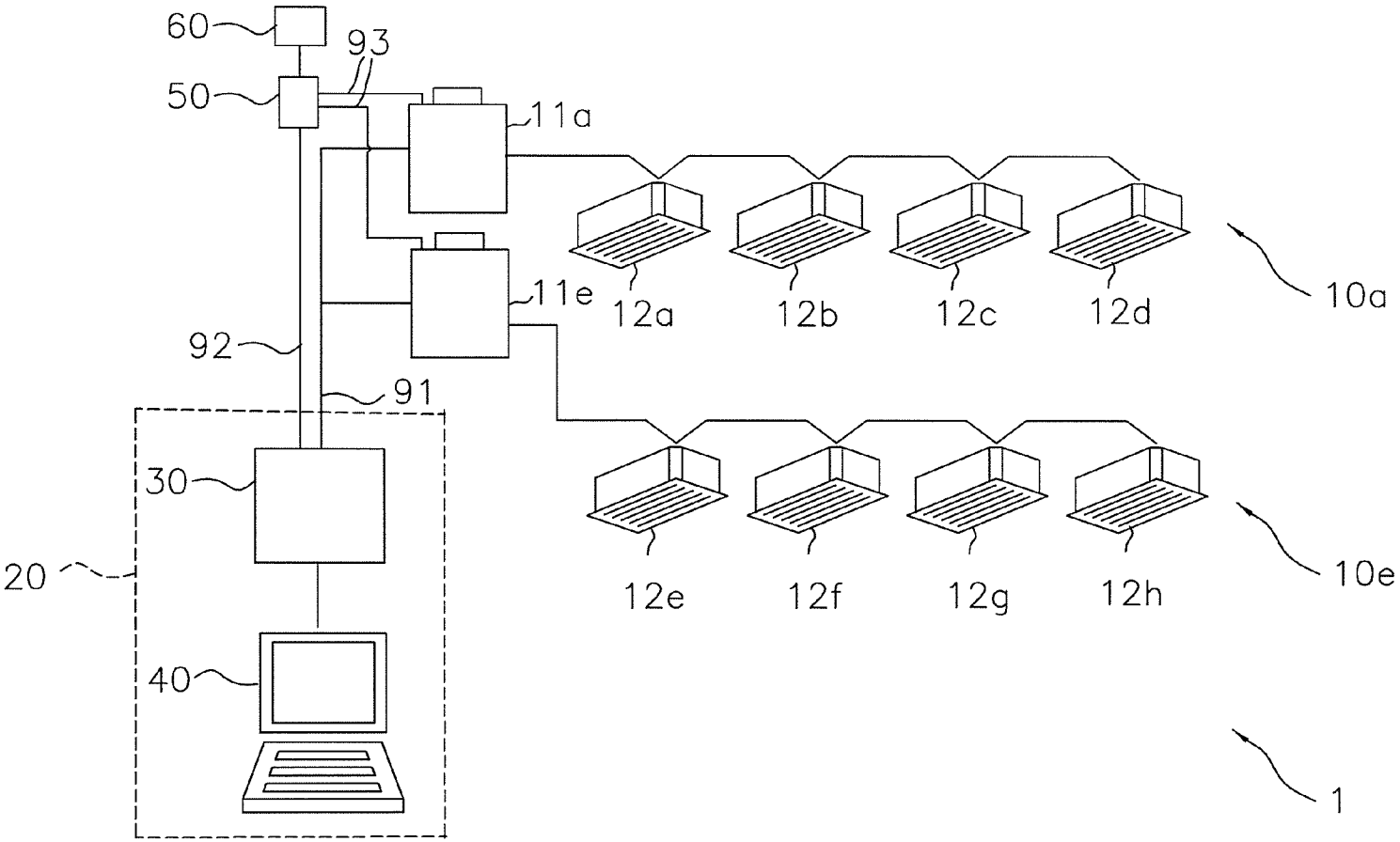
FIG. 1 is a configuration diagram of an energy saving support system pertaining to an embodiment.

FIG. 1 is a configuration diagram of an energy saving support system 1 having an energy saving support device 20 pertaining to one embodiment of the present invention. The energy saving support system 1 pertaining to the present embodiment is a system used in a building such as a building occupied by multiple offices or multiple tenants. The energy saving support system 1 in FIG. 1 is mainly configured by air conditioners 10*a* and 10*e* and the energy saving support device 20.

Figure 2:
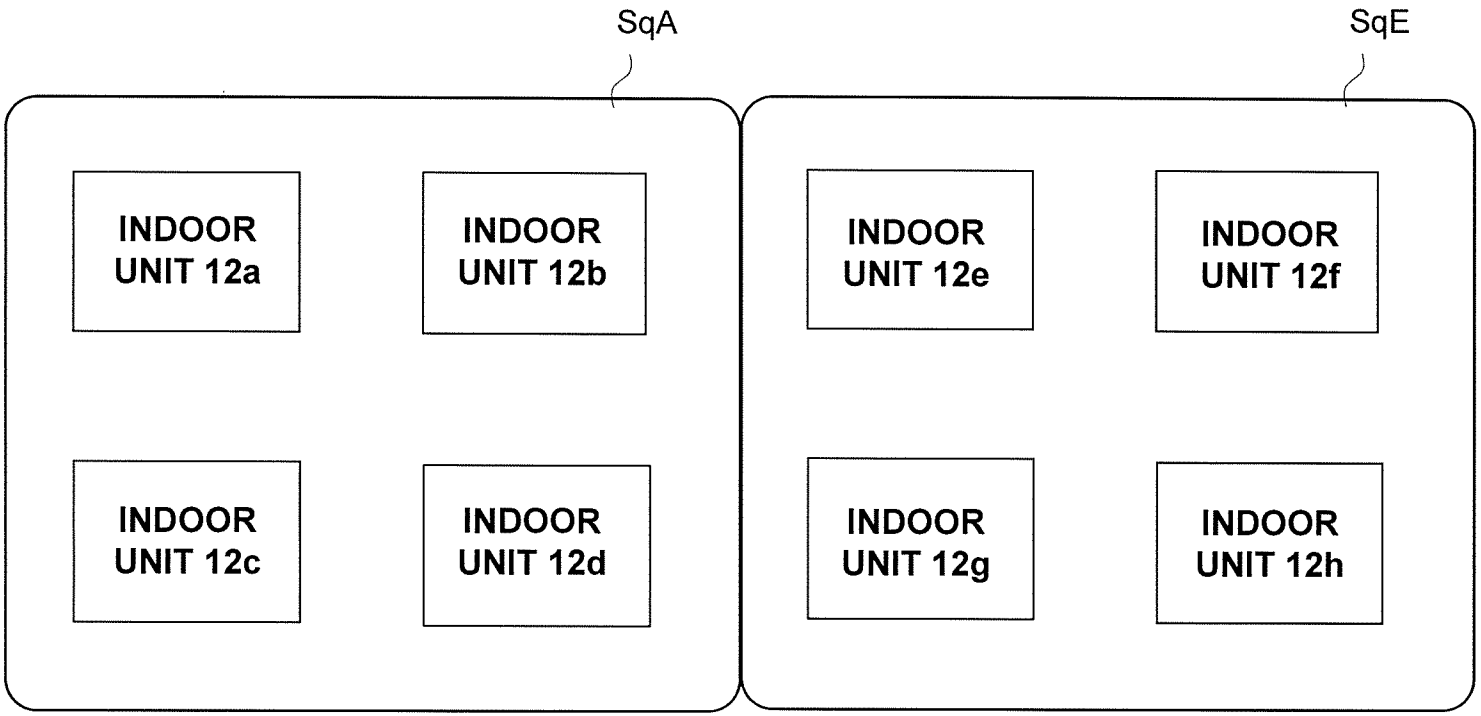
FIG. 2 is a layout diagram of indoor units pertaining to the embodiment.

In the air conditioner 10*a*, four indoor units 12*a*, 12*b*, 12*c*, and 12*d* are connected to one outdoor unit 11*a*, and in the air conditioner 10*e*, four indoor units 12*e*, 12*f*, 12*g*, and 12*h* are connected to one outdoor unit 11*e*. That is, the air conditioners 10*a* and 10*e* pertaining to the present embodiment are so-called split system air conditioners. Each of the outdoor units 11*a* and 11*e* is installed outside the building, such as on the roof of the building, and each of the indoor units 12*a* to 12*h* is installed inside the building. In particular, in the present embodiment, as shown in FIG. 2, a case where the indoor units 12*a* to 12*d* are installed inside one room SqA in the building (that is, inside one air conditioning target space) and where the indoor units 12*e* to 12*h* are installed inside one room SqE in the building (that is, inside one air conditioning target space) will be taken as an example. That is, in the present embodiment, the air conditioners are placed such that one each of the outdoor units 11*a* and 11*e* is installed with respect to one room. In FIG. 1 and FIG. 2, an example where the four indoor units 12*a* to 12*d* are connected to the one outdoor unit 11*a* and where the four indoor units 12*e* to 12*h* are connected to the one outdoor unit 11*e* is shown, but the numbers of the outdoor units 11*a* and 11*e* and the indoor units 12*a* to 12*h* are not limited to this. Further, in the present embodiment, a case where the two rooms SqA and SqE are disposed inside one building will be taken as example and described, but the number of the rooms disposed inside one building is not limited to this and may be any number.

The energy saving support device 20 is a device for supporting energy saving of each of the air conditioners 10*a* and 10*e*. The energy saving support device 20 is connected to each of the outdoor units 11*a* and 11*e* via an air conditioner communication line 91, transmits control commands to each of the outdoor units 11*a* and 11*e*, and receives operating data of each of the air conditioners 10*a* and 10*e*. The operating data will be described in "(2-1) Controller" in "(2) Configuration of Energy Saving Support Device". Further, the energy saving support device 20 is connected to an energy meter 50 via a power line 92 and can receive a consumed power of each the air conditioners 10*a* and 10*e* sent from the energy meter 50.

Here, the energy meter 50 is connected in the middle of a power source line 93 extending from the output of a power source 60 to each of the outdoor units 11*a* and 11*e* and can measure the power that the power source 60 supplies to each of the outdoor units 11*a* and 11*e* and each of the indoor units 12*a* to 12*h*. That is, the energy meter 50 can measure the consumed power in the air conditioners 10*a* and 10*e*.

(2) Configuration of Energy Saving Support Device

Next, the configuration of the energy saving support device 20 pertaining to the present embodiment will be described. The energy saving support device 20 pertaining to the present embodiment is configured by a controller 30 and an assist device 40.

(2-1) Controller

Figure 3:
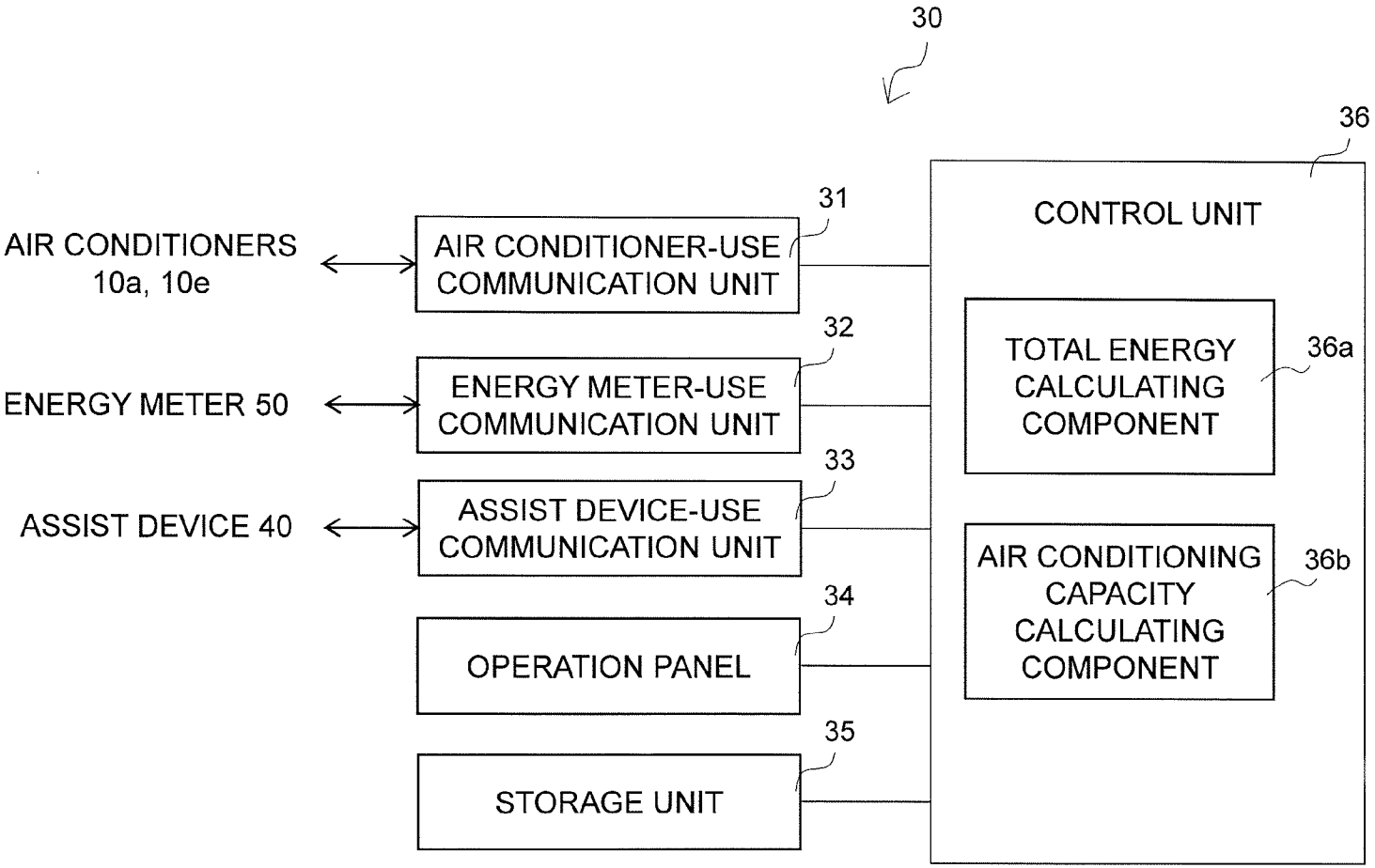
FIG. 3 is a diagram generally showing the internal configuration of a controller configuring part of an energy saving support device pertaining to the embodiment.

As shown in FIG. 3, the controller 30 has an air conditioner-use communication unit 31, an energy meter-use communication unit 32 (the air conditioner-use communication unit 31 and the energy meter-use communication unit 32 correspond to an acquiring unit), an assist device-use communication unit 33, an operation panel 34, a storage unit 35, and a control unit 36.

The air conditioner-use communication unit 31 is for performing communication with the air conditioners 10*a* and 10*e*. For example, the air conditioner-use communication unit 31 transmits control orders of each of the indoor units 12*a* to 12*h* to each of the outdoor units 11*a* and 11*e* via the air conditioner communication line 91 and receives the operating data regarding each of the air conditioners 10*a* and 10*e* from each of the outdoor units 11*a* and 11*e*.

Here, examples of the operating data pertaining to the present embodiment may include data relating to the operating histories and data relating to the operating states of the air conditioners 10*a* and 10*e*. Specifically, examples of the data relating to the operating history may include the on and off of the power source of each of the indoor units 12*a* to 12*h*, the on and off of a thermostat, various operating modes (specifically, a cooling mode, a heating mode, a fan mode, etc.), set temperature, etc. Examples of the data relating to the operating state may include values detected by various sensors and various gauges installed in the air conditioners 10*a* and 10*e* (for example, the temperatures inside the rooms; that is, the suction temperatures). The air conditioner-use communication unit 31 receives the operating data mentioned above from each of the outdoor units 11*a* and 11*e*. Because of these operating data, the energy saving support device 20 can grasp the operating times of each of the indoor units 12*a* to 12*h*, the opening degrees of their indoor expansion valves, their evaporating pressures Pe, their condensing pressures Pc, etc. Moreover, examples of the operating data pertaining to the present embodiment may include the consumed energies of the air conditioners 10*a* and 10*e*, but the consumed energies are acquired by the energy meter-use communication unit 32 from the energy meter 50.

The energy meter-use communication unit 32 is for performing communication with the energy meter 50. As has already been mentioned, the energy meter-use communication unit 32 can receive from the energy meter 50 the consumed energies of the air conditioners 10*a* and 10*e* that are one of the operating data. Here, the consumed energies that the energy meter-use communication unit 32 receives correspond to total consumed energies that the air conditioners 10*a* and 10*e* have consumed at the time. That is, the consumed energies that the energy meter-use communication unit 32 receives respectively correspond to the combined value of the present energy that the one outdoor unit 11*a* has consumed and the present energies that the four indoor units 12*a* to 12*d* connected to this outdoor unit 11*a* have consumed, and the combined value of the present energy that the one outdoor unit 11*e* has consumed and the present power that the four indoor units 12*e* to 12*h* connected to this outdoor unit 11*e* have consumed. That is, the consumed energies correspond to the consumed energy of each of the air conditioners 10*a* and 10*e* in each of the rooms SqA and SqE at the time. The energy meter-use communication unit 32 can acquire these consumed energies every one minute, for example.

The assist device-use communication unit 33 is for performing communication with the assist device 40. For example, the assist device-use communication unit 33 transmits to the assist device 40 the operating data that the air conditioner-use communication unit 31 has received, total consumed energies Etl that the control unit 36 functioning as a total energy calculating component 36*a* (described later) has calculated, air conditioning capacities Q that the control unit 36 functioning as an air conditioning capacity calculating component 36*b* (described later) has calculated, etc.

The operation panel 34 is a touch panel configured by a liquid crystal display and a matrix switch, for example, and can display various screens. Examples of the screens that the operation panel 34 displays may include a setting screen relating to airflow control of each of the indoor units 12*a* to 12*h* that the control unit 36 performs and a screen for allowing each of the indoor units 12*a* to 12*h* to be switched on and off. According to this operation panel 34, the user of the energy saving support system 1 can switch each of the indoor units 12*a* to 12*h* on and off and perform setting relating to airflow control by directly touching the screens displayed on the screen of the operation panel 34. Moreover, the operation panel 34 can display the operating data of each of the air conditioners 10*a* and 10*e*, such as the various operating modes of each of the indoor units 12*a* to 12*h*, the set temperatures, the temperatures inside the rooms, etc.

The storage unit 35 is configured by a HDD or a flash memory and can store operating data regarding each of the air conditioners 10*a* and 10*e*. That is, examples of the operating data that the storage unit 35 stores may include the operating data of each of the air conditioners 10*a* and 10*e* that the air conditioner-use communication unit 31 has received (excluding the consumed energies of the air conditioners 10*a* and 10*e*) and the consumed energies of each of the air conditioners 10*a* and 10*e* that the energy meter-use communication unit 32 has received. Moreover, the storage unit 35 can store the total consumed energies Etl that the control unit 36 functioning as the total energy calculating component 36*a* (described later) has calculated. In view of the storage capacity of the storage unit 35, it is preferable for the storage unit 35 to store the operating data and the total consumed energies Etl from the newest data to until a predetermined period ago.

The control unit 36 is a microcomputer configured by a CPU and a RAM and performs control of the various units to which it is connected. Specifically, the control unit 36 is connected to the air conditioner-use communication unit 31, the energy meter-use communication unit 32, and the assist device-use communication unit 33 and performs communication control of each of the communication units 31 to 33. Further, the control unit 36 performs generation of control commands based on airflow control and control of the on and off of each of the indoor units 12*a* and 12*h*. In particular, the control unit 36 pertaining to the present embodiment performs calculation of the total consumed energy Etl and performs calculation of the air conditioning capacity Q in each of the air conditioners 10*a* and 10*e*. Because it performs these actions, the control unit 36 functions as the total energy calculating component 36*a* (which corresponds to a first energy calculating unit) and the air conditioning capacity calculating component 36*b*.

<Total Energy Calculating Component>

The total energy calculating component 36*a* calculates, as comparison target energies, the total consumed energy Etl of each of the air conditioners 10*a* and 10*e* on the basis of the operating data including the consumed energy of each of the air conditioners 10*a* and 10*e*. Specifically, the total energy calculating component 36*a* calculates, as the total consumed energy, an integrated value in a predetermined period of the consumed energies per system in each of the outdoor units 11*a* and 11*e*. That is, the total energy calculating component 36*a* calculates the total consumed energy Etl of each of the air conditioners 10*a* and 10*e* in the predetermined period per each of the rooms SqA and SqE. Consequently, included in the total consumed energy Etl are a total consumed energy Eo, which is an integrated value in the predetermined period of the energy that each of the outdoor units 11*a* and 11*e* has consumed, and a total consumed energy Elk, which is an integrated value in the predetermined period of the energy that each of the indoor units 12*a* to 12*d* and 12*e* to 12*f* has consumed.

The total consumed energy Etl pertaining to the present embodiment corresponds to the sum of consumed energy in a state where the coefficient of performance (called "COP" below) of each of the air conditioners 10*a* and 10*e* in each of the rooms SqA and SqE is low and consumed energy in a case where the COP is not in a low state.

Below, for convenience of description, consumed energy in a state where the COP is low will be called "the low-COP consumed energy", and details of the low-COP consumed energy will be described in "<Low-COP Power Calculating Component>".

Here, the predetermined period in which the total energy calculating component 36*a* integrates the energy is one hour, for example. That is, the total energy calculating component 36*a* integrates the energy it has acquired during one hour and, when one hour passes, resets the integration result and again integrates the energy.

<Air Conditioning Capacity Calculating Component>

The air conditioning capacity calculating component 36*b* estimates the air conditioning capacity Q of each of the air conditioners 10*a* and 10*e* on the basis of the operating data of each of the air conditioners 10*a* and 10*e*. Specifically, the air conditioning capacity calculating component 36*b* calculates the air conditioning capacity by multiplying a refrigerant circulation volume G by the enthalpy difference of an evaporator or a condenser in each of the indoor units 12*a* to 12*h*. Here, an air conditioning capacity Qc during cooling is calculated by multiplying the refrigerant circulation volume G by an enthalpy difference Δic of the evaporator ($Qc=\Delta ic\times G$), and an air conditioning capacity Qh during heating is calculated by multiplying the refrigerant circulation volume G by an enthalpy difference Δih of the condenser ($Qh=\Delta ih\times G$).

Figure 4:
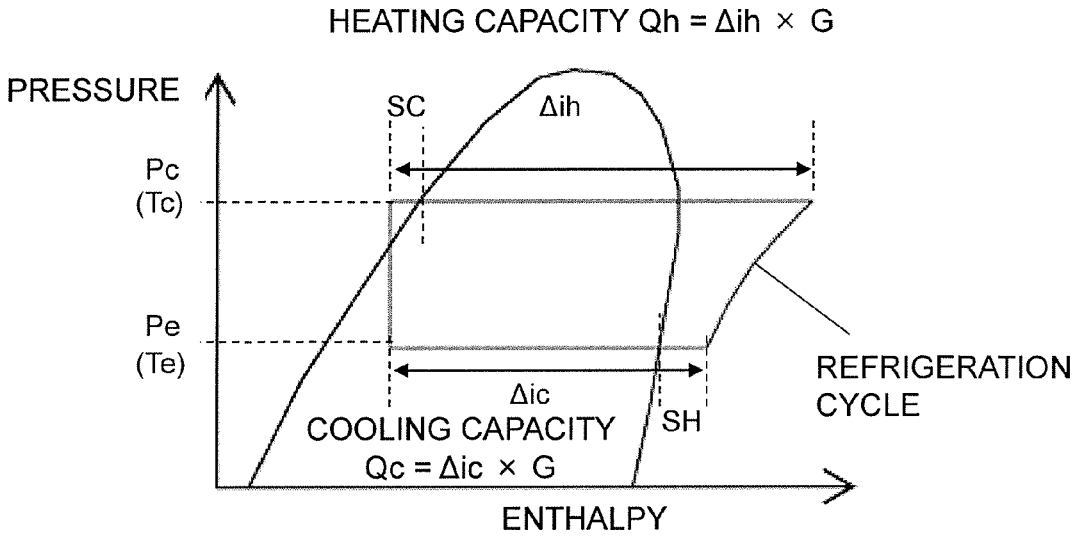
FIG. 4 is a Mollier diagram showing enthalpy differences in cooling and heating.

The air conditioning capacity calculating component 36*b* estimates, on the basis of the operating data that the air conditioner-use communication unit 31 has acquired, the enthalpy differences Δic and Δih and the refrigerant circulation volume G used in the above calculation. Specifically, the enthalpy differences Δic and Δih are obtained by the evaporating pressure Pe, the condensing pressure Pc, and control target values (superheating SH and subcooling SC) grasped by the operating data that the air conditioner-use communication unit 31 has acquired—that is, the data relating to the operating history and the data relating to the operating state of each of the air conditioners 10*a* and 10*e*. FIG. 4 is a Mollier diagram showing enthalpy differences in cooling and heating, with the horizontal axis representing enthalpy and the vertical axis representing pressure. In FIG. 4, the relationship between the evaporating pressure Pe, the condensing pressure Pc, the superheating SH, the subcooling SC, and the enthalpy differences Δic and Δih is shown.

Moreover, in calculating the above mentioned air conditioning capacities Qc and Qh, the air conditioning capacity calculating component 36*b* uses the refrigerant circulation volume G which is calculated using a saturation temperature Te equivalent to evaporating pressure and a saturation temperature Tc equivalent to condensing pressure ($G=f(Te, Tc)$). For a method of calculating the refrigerant circulation volume G, see ARI Standard 540, *Standard for Performance Rating of Positive Displacement Refrigerant Compressors and Com-*

*pressor Units,* 2004, and Carl C. Hiller, "Detailed modeling and computer simulation of reciprocating refrigeration compressors," in *Proc. of International Compressor Engineering Conference at Purdue,* 1976, pp. 12-16. Here, the saturation temperature Te equivalent to evaporating pressure and the saturation temperature Tc equivalent to condensing pressure are variables respectively decided by the evaporating pressure Pe and the condensing pressure Pc.

The action of estimating the air conditioning capacities mentioned above is, like the integration of the energy, performed every one hour, for example.

(2-2) Assist Device

Figure 5:
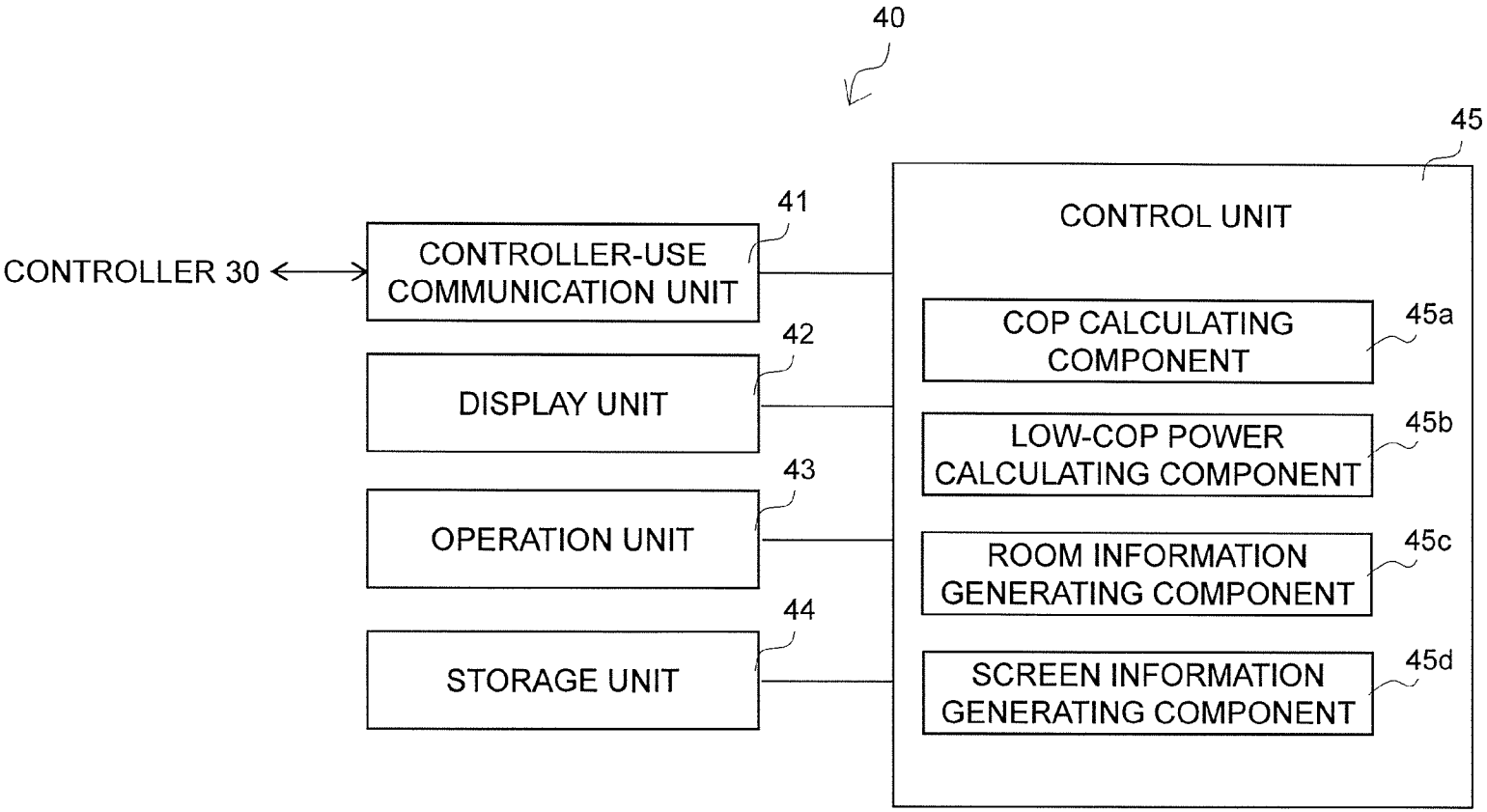
FIG. 5 is a diagram generally showing the internal configuration of an assist device configuring part of the energy saving support device pertaining to the embodiment.

As shown in FIG. 5, the assist device 40 has a controller-use communication unit 41, a display unit 42 (which corresponds to a reporting unit), an operation unit 43, a storage unit 44, and a control unit 45.

The controller-use communication unit 41 is for performing communication with the controller 30 via the assist device-use communication unit 33. For example, the controller-use communication unit 41 receives the operating data of each of the air conditioners 10*a* and 10*e*, the total consumed energies Etl and the air conditioning capacities that have been calculated by the controller 30, etc.

Figure 6:
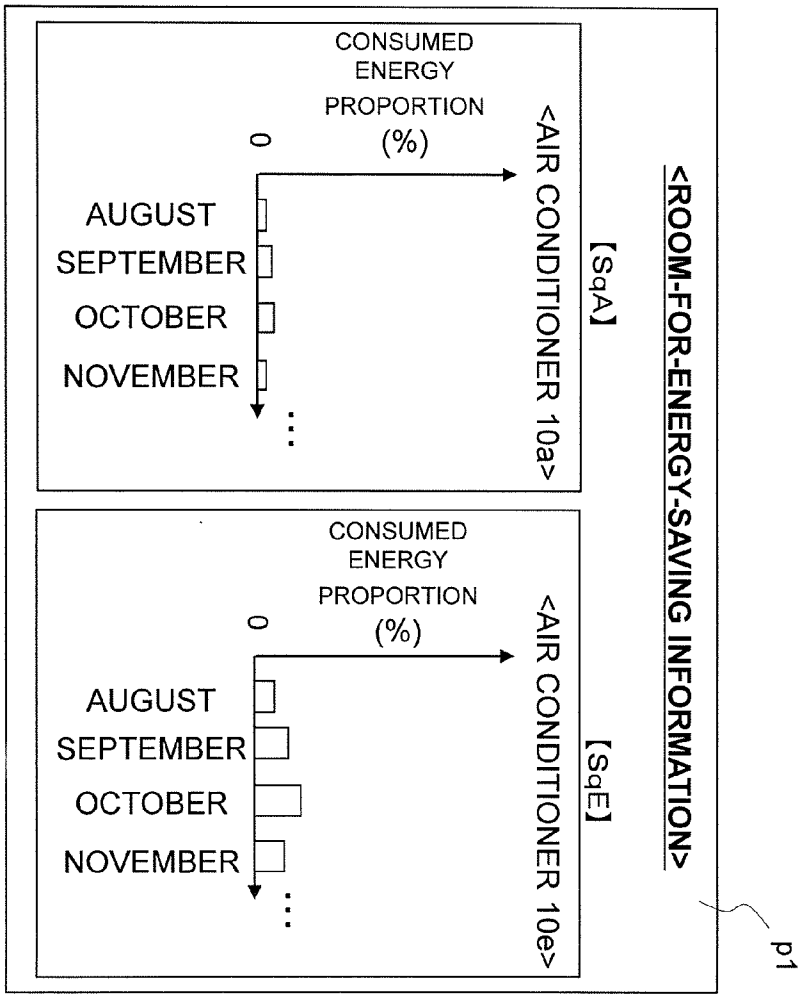
FIG. 6 is an example of a screen on which room-for-energy-saving information is displayed.

The display unit 42 is configured by a liquid crystal display and can display various screens. As shown in FIG. 6, examples of the screens that the display unit 42 pertaining to the present embodiment displays may include a screen p1 on which the room-for-energy-saving information is displayed. Here, the room-for-energy-saving information is information that becomes an index for allowing the user of the energy saving support system 1 to perform energy saving and is generated by the control unit 45 functioning as a room information generating component 45*c* (described later). Details of the room-for-energy-saving information will be described in "<Room Information Generating Component>".

The operation unit 43 comprises a keyboard equipped with alphabetical keys and numerical keys and a pointing device such as a mouse, for example, and is used in a case where the user performs setting of various conditions on the basis of the various screens displayed on the display unit 42. In particular, the operation unit 43 pertaining to the present embodiment can accept instructions given by the user to read through the room-for-energy-saving information. In this way, the operation unit 43 can accept various operations performed by the user.

The storage unit 44 is, like the storage unit 35 in the controller 30, configured by a HDD or a flash memory. The storage unit 44 can store the operating data, the total consumed energies Etl, the air conditioning capacities, etc. of each of the air conditioners 10*a* and 10*e* that the controller-use communication unit 41 has received. Moreover, the storage unit 44 can store the COP of each of the air conditioners 10*a* and 10*e* that the control unit 45 functioning as a COP calculating component 45*a* (described later) has calculated, the low-COP consumed energies that the control unit 45 functioning as a low-COP power calculating component 45*b* (described later) has calculated, and the room-for-energy-saving information.

The control unit 45 is, like the control unit 36 pertaining to the controller 30, a microcomputer configured by a CPU and a RAM and performs control of the various units to which it is connected. Specifically, the control unit 45 is connected to the controller-use communication unit 41, the display unit 42, and the operation unit 43 and performs communication control and display control. In particular, the control unit 45 pertaining to the present embodiment performs actions by which it generates information regarding energy saving (that is, the room-for-energy-saving information) and causes the display unit 42 to display this in order to support energy saving with respect to the user of the energy saving support system 1. Because it performs these actions, the control unit 45 functions as the COP calculating component 45*a*, the low-COP power calculating component 45*b* (which corresponds to a second energy calculating unit), the room information generating component 45*c* (which corresponds to an information generating unit), and a screen information generating component 45*d*.

<COP Calculating Component>

The COP calculating component 45*a* calculates the COP of each of the air conditioners 10*a* and 10*e*. In other words, the COP calculating component 45*a* calculates the COP per system in the single outdoor units 11*a* and 11*e*—that is, per each of the rooms SqA and SqE. Here, examples of the COP of each of the air conditioners 10*a* and 10*e* may include unit COP and system COP, but in the present embodiment, a case where the COP calculating component 45*a* calculates the system COP will be taken as an example. The system COP is obtained by dividing each of the air conditioning capacities Q by the total consumed energy Etl in each of the air conditioners 10*a* and 10*e* (system COP=Q/Etl).

<Low-COP Power Calculating Component>

The low-COP power calculating component 45*b* obtains, on the basis of the operating data of each of the air conditioners 10*a* and 10*e* that the controller-use communication unit 41 has received from the controller 30, the low-COP consumed energy that is the energy that each of the air conditioners 10*a* and 10*e* consumed when it was operating at a COP equal to or less than a predetermined value. Specifically, the low-COP power calculating component 45*b* extracts, from the total consumed energy Etl of each of the air conditioners 10*a* and 10*e* every predetermined period (that is, every one hour) calculated on the basis of the operating data by the total energy calculating component 36*a* of the controller 30, the total consumed energy Etl in a case where the COP of each of the air conditioners 10*a* and 10*e* obtained by the COP calculating component 45*a* is equal to or less than ½ of a rated COP and uses this as the low-COP consumed energy. For example, in a case where the COP during a certain one hour of the air conditioner 10*a* inside the room SqA is equal to or less than ½ of the rated COP, the low-COP power calculating component 45*b* decides the total consumed energy Etl of the air conditioner 10*a* during that time as the low-COP consumed energy.

As has already been mentioned, the action of calculating the COP of each of the indoor units 12*a* to 12*h* pertaining to the present embodiment is performed every one hour, so the low-COP power calculating component 45*b* performs the above action every one hour.

<Room Information Generating Component>

The room information generating component 45*c* generates, on the basis of the total consumed energy and the low-COP consumed energy of each of the air conditioners 10*a* and 10*e*, the room-for-energy-saving information for judging whether there is a lot of or little room for energy saving. Specifically, the room information generating component 45*c* integrates, by month for each of the air conditioners 10*a* and 10*e*, the low-COP power consumed energy calculated by the low-COP power calculating component 45*b*. Further, the room information generating component 45*c* also integrates, by month for each of the air conditioners 10*a* and 10*e*, the total consumed energy of each of the air conditioners 10*a* and 10*e* obtained by the total energy calculating component 36*a* (that is, the sum of the consumed energy in a case where the COP is equal to or less than ½ of the rated COP and the energy consumption in a case where the COP is not in a low state).

Additionally, the room information generating component 45*c* generates, as the room-for-energy-saving information, the proportion of the low-COP consumed energy during the one month it has integrated (that is, the total consumed energy in a case where the COP was equal to or less than ½ of the rated COP) with respect to the total consumed energy during the one month it has integrated for each of the air conditioners 10*a* and 10*e*. Because of this, information in which the low-COP consumed energy is expressed as a percent in a case where 100% represents the total consumed energy per month of each of the air conditioners 10*a* and 10*e* during one month is obtained as the room-for-energy-saving information (see FIG. 6). The room information generating component 45*c* generates this room-for-energy-saving information in regard to each of the air conditioners 10*a* and 10*e* and every predetermined period (here, by month).

<Screen Information Generating Component>

The screen information generating component 45*d* generates screen information for the room-for-energy-saving information generated by the room information generating component 45*c* to be displayed on the display unit 42. Specifically, as shown in FIG. 6, the screen information generating component 45*d* generates screen information so that the room-for-energy-saving information generated for each of the air conditioners 10*a* and 10*e* and per one month is arranged on one screen so that the air conditioners 10*a* and 10*e* installed in each of the rooms SqA and SqE inside the one building can be compared. Because of this, as shown in FIG. 6, the room-for-energy-saving information of the individual air conditioners 10*a* and 10*e* is displayed on one screen on the display unit 42, so it becomes easier for the user utilizing the energy saving support system 1 to judge in which of the rooms SqA and SqE in which the air conditioners 10*a* and 10*e* are installed is there a lot of room for energy saving. In particular, in FIG. 6, there is shown one example of the screen p1 on which the proportion of the low-COP consumed energy with respect to the total consumed energy of each of the air conditioners 10*a* and 10*e* (that is, the sum of the consumed energy in a case where the COP is equal to or less than ½ of the rated COP and the consumed energy in a case where the COP is not in a low state) is displayed, with the horizontal axis representing months and the vertical axis representing consumed energy proportion (%). That is, in FIG. 6, the proportion of the low-COP consumed energy with respect to the total consumed energy of the air conditioners 10*a* and 10*e* is displayed as a percent together with information relating to date and time. For that reason, it becomes easier for the user to judge how often and when a state where the air conditioner is operating at a COP equal to or less than ½ of the rated COP is going on.

(3) Actions of Energy Saving Support Device

Next, the actions that the energy saving support device 20 pertaining to the present embodiment performs will be described using FIG. 7.

Steps S1 to S2: When the controller 30 in the energy saving support device 20 acquires the operating data from each of the air conditioners 10*a* and 10*e* every one minute (S1), for example, it calculates the total consumed energy Etl of each of the air conditioners 10*a* and 10*e* hourly, for example. The assist device 40 uses the operating data that the controller 30 has acquired to calculate the COP of each of the air conditioners 10*a* and 10*e* hourly (S2). The controller 30 repeatedly performs the actions of steps S1 and S2. The hourly total consumed energies Etl and COPs that have been calculated are stored in the storage unit 35 of the controller 30.

Steps S3 to S6: In a case where there is an instruction to read through the room-for-energy-saving information from the user via the operation unit 43 of the assist device 40 (Yes in S3), the assist device 40 starts the action of displaying the room-for-energy-saving information. That is, in a case where there is a COP equal to or less than ½ of the rated COP of the hourly COPs of each of the air conditioners 10*a* and 10*e* obtained in step S2 (Yes in S4), the assist device 40 uses the total consumed energy EU of each of the air conditioners 10*a* and 10*e* corresponding to this COP as the low-COP consumed energy. The assist device 40 integrates, for each of the air conditioners 10*a* and 10*e* and by month, the low-COP consumed energy obtained in this way (S5). Further, the assist device 40 also integrates, for each of the air conditioners 10*a* and 10*e* and by month, the total consumed energies of the air conditioners 10*a* and 10*e* of step S2 calculated every one hour. The assist device 40 performs the actions of steps S4 and S5 for 12 months' worth (S6).

Step S7: After it has performed the actions of steps S4 and S5 for 12 months' worth in step S6 (Yes in S6), the assist device 40 generates, as the room-for-energy-saving information, the proportion of the low-COP consumed energy with respect to the total consumed energy of each of the air conditioners 10*a* and 10*e* during one month in all of the period (that is, 12 months' worth). That is, the assist device 40 performs the action of generating the room-for-energy-saving information for each of the air conditioners 10*a* and 10*e* and by month for 12 months' worth.

Step S8: The assist device 40 arranges and displays the room-for-energy-saving information of each of the air conditioners 10*a* and 10*e* such that the room-for-energy-saving information of each of the air conditioners 10*a* and 10*e* obtained in step S7 can be compared (FIG. 6).

(4) Advantageous Effects (A)

According to the energy saving support device 20 pertaining to the present embodiment, the room-for-energy-saving information that is the proportion of the low-COP consumed energy with respect to the total consumed energy is generated and displayed on the basis of the total consumed energy and the low-COP consumed energy. Because of this room-for-energy-saving information, that is, information relating to the consumed energies of the air conditioners 10*a* and 10*e*, the user utilizing the energy saving support system 1 can easily grasp the air conditioners 10*a* and 10*e* in which there is room for energy saving. Consequently, the user can take measures to reduce consumed energy with respect to the air conditioners 10*a* and 10*e* judged as having a lot of room for energy saving.

(B)

Further, according to the energy saving support device 20 pertaining to the present embodiment, the proportion of the low-COP consumed energy with respect to the total consumed energy is displayed as the room-for-energy-saving information. Because of this, the user can know to what extent the air conditioners 10*a* and 10*e* are performing an operation with poor efficiency, so the user can grasp how much room there is in which consumed energy can be reduced with respect to the total consumed energy.

(C)

Further, according to the energy saving support device 20 pertaining to the present embodiment, as shown in FIG. 6, the consumed energy in a case where the COP is equal to or less than ½ of the rated COP (that is, the low-COP consumed energy) is shown as a percent, so the user can easily grasp how often the air conditioners 10*a* and 10*e* are performing an operation with poor efficiency.

(D)

Further, according to the energy saving support device 20 pertaining to the present embodiment, as shown in FIG. 6, the room-for-energy-saving information of each of the plural air conditioners 10*a* and 10*e* is comparably displayed. For this reason, the user can know at once how much room for energy saving there is in each of the air conditioners 10*a* and 10*e*. Consequently, the user can compare the extent of the room for energy saving in each of the air conditioners 10*a* and 10*e*, assign priority in descending order of the room for energy saving, for example, and perform measures to reduce consumed energy.

(E)

Further, in the present embodiment, as shown in FIG. 6, the room-for-energy-saving information is displayed together with information relating to date and time. Because of this, the user can know when the air conditioners 10*a* and 10*e* performed an operation with poor efficiency.

Other Embodiments (a)

In the above embodiment, a case where the energy saving support device 20 is configured by the controller 30 and the assist device 40 has been described. However, the energy saving support device 20 may also be configured by one device rather than being divided into and configured by two devices.

(b)

In the above embodiment, as shown in FIG. 6, a case where the room-for-energy-saving information is displayed as the proportion of the low-COP consumed energy with respect to the total consumed energy of each of the air conditioners 10*a* and 10*e* has been described. However, as shown in a screen p2 in FIG. 8, the room-for-energy-saving information may also be of a form showing at the same time—that is, on one graph—the total consumed energy (that is, the absolute quantity of the total consumed energy) and the low-COP consumed energy (that is, the absolute quantity of the total consumed energy) of each of the air conditioners 10*a* and 10*e*. That is, the room-for-energy-saving information in this case is information comprising the absolute quantity of the total consumed energy and the absolute quantity of the low-COP consumed energy. In the screen p2 in FIG. 8, the absolute quantity of the total consumed energy regarding each of the air conditioners 10*a* and 10*e* is given a different color from that of the absolute quantity of the low-COP consumed energy, and the absolute quantity of the total consumed energy and the absolute quantity of the low-COP consumed energy are displayed such that they are visually graspable. Because of the screen p2, the user can visually easily grasp to what extent each of the air conditioners 10*a* and 10*e* is performing an operation with poor efficiency.

Figure 8:
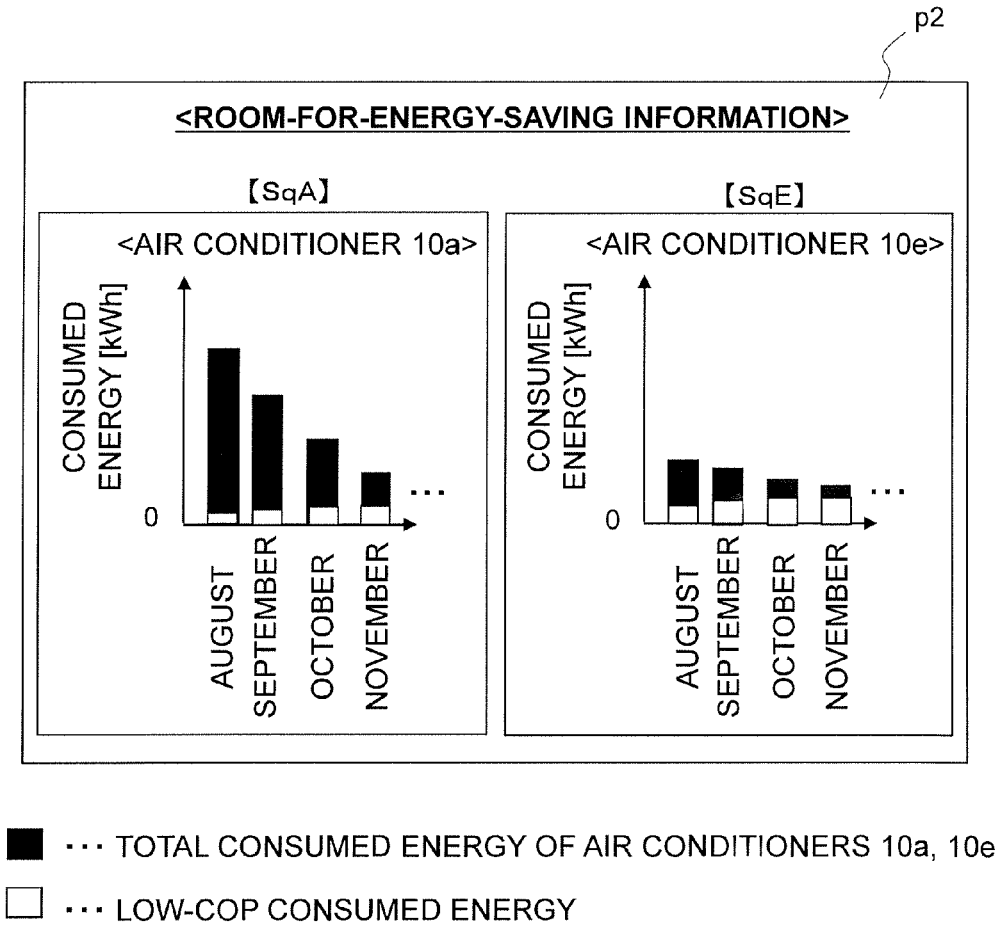
FIG. 8 is an example of a screen where, in the example of the screen in FIG. 6, the room-for-energy-saving information is displayed in a form showing at the same time a total consumed energy and a low-COP consumed energy of air conditioners.

Further, in FIG. 8, the absolute quantity of the total consumed energy and the absolute quantity of the low-COP consumed energy are given mutually different colors, but they may also be given mutually different patterns.

Further, in FIG. 6, the proportion of the low-COP consumed energy with respect to the total consumed energy of each of the air conditioners 10*a* and 10*e* is shown in a bar graph, but the form of the graph is also not limited to this and the proportion may also be shown in a pie chart, for example.

(c)

Figure 9:
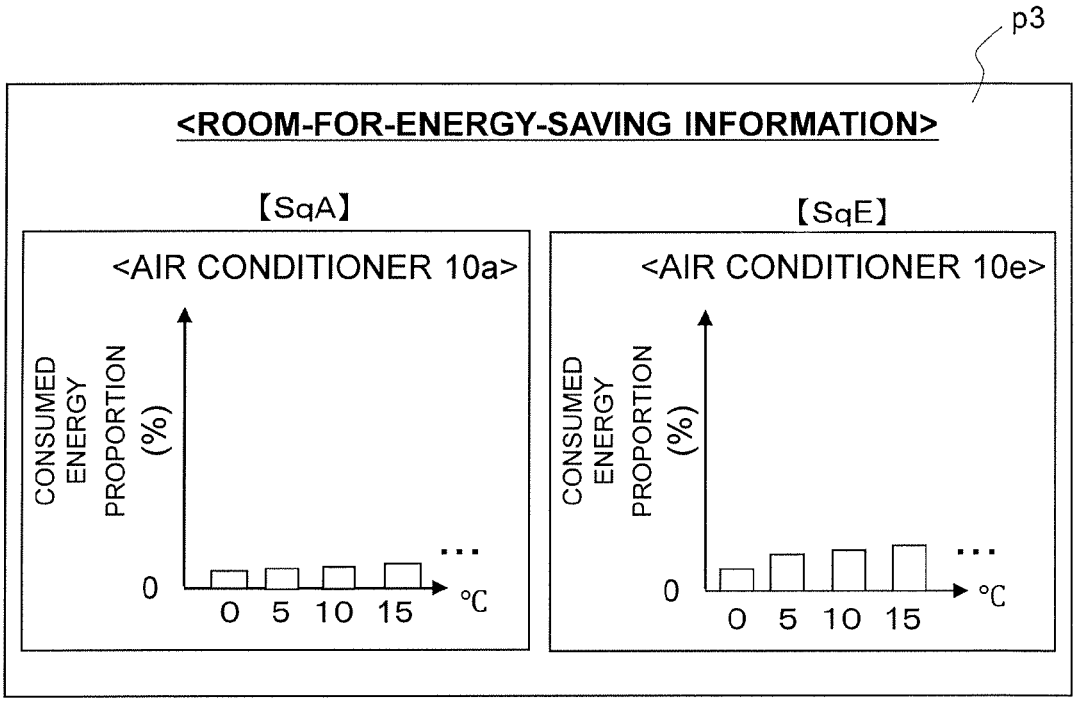
FIG. 9 is an example of a screen on which the room-for-energy-saving information that is the proportion of the low-COP consumed energy with respect to total consumed energy of the air conditioners is displayed with the horizontal axis representing outside air temperature.

Further, in FIG. 6 pertaining to the above embodiment, a case where the room-for-energy-saving information is shown with the horizontal axis representing months (that is, information relating to date) has been described. However, as shown in a screen p3 in FIG. 9, the room-for-energy-saving information may also be displayed together with information relating to outside air temperature. Specifically, in FIG. 9, the horizontal axis represents outside air temperature, the vertical axis represents consumed energy proportion (%), and the room-for-energy-saving information is shown as the proportion of the low-COP consumed energy with respect to the total consumed energy of each of the air conditioners 10*a* and 10*e* like in FIG. 6.

Figure 10:
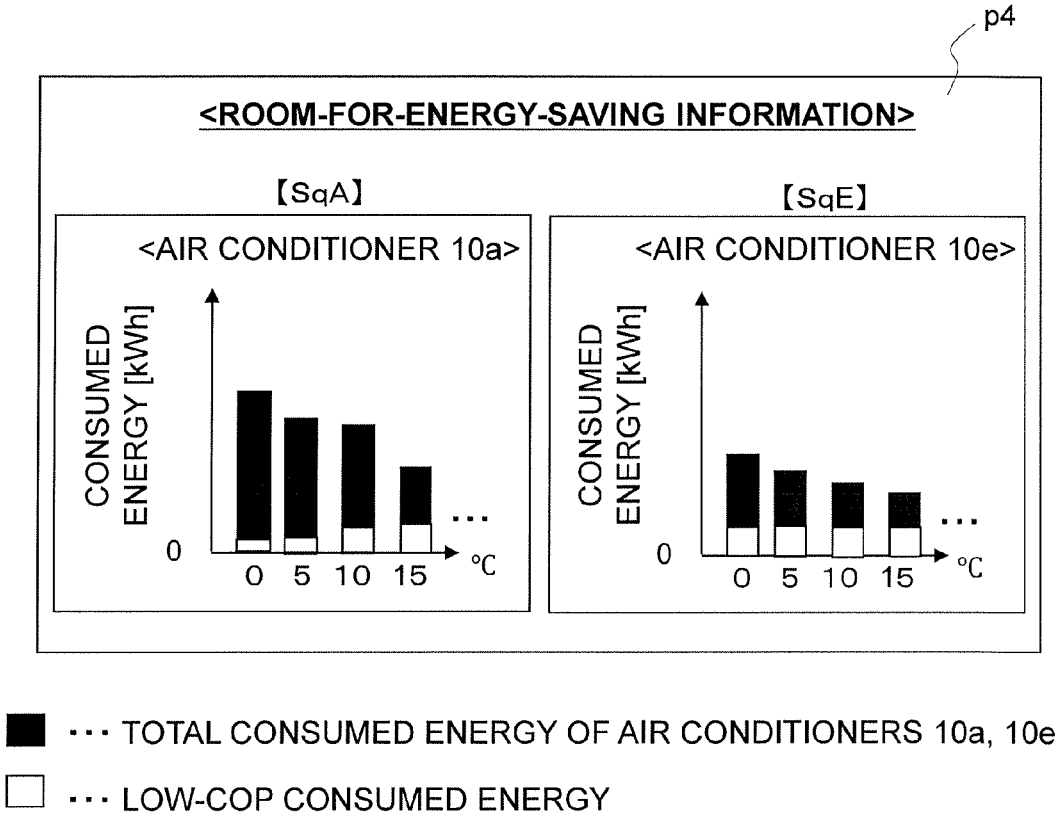
FIG. 10 is an example of a screen where, in the example of the screen in FIG. 9, the room-for-energy-saving information is displayed in a form showing at the same time the total consumed energy and the low-COP consumed energy of the air conditioners.

Moreover, in a case where the horizontal axis represents outside air temperature, as shown in a screen p4 in FIG. 10, like in the other embodiment (b), the room-for-energy-saving information may also be of a form showing at the same time—that is, on one graph—the total consumed energy (that is, that absolute quantity of the total consumed energy) and the low-COP consumed energy (that is, the absolute quantity of the low-COP consumed energy) of each of the air conditioners 10*a* and 10*e*.

In this way, the room-for-energy-saving information is displayed together with information relating to outside air temperature, so the user can know in what environmental conditions the efficiency of the air conditioners 10*a* and 10*e* goes down.

In a case where the horizontal axis represents outside air temperature, the total consumed energy and the low-COP consumed energy are obtained per outside air temperature rather than in units of months.

(d)

In the above embodiment, a case where the room-for-energy-saving information is displayed as the proportion of the low-COP consumed energy with respect to the total consumed energy of each of the air conditioners 10*a* and 10*e* has been described. However, the room-for-energy-saving information may also be the difference between a standard consumed energy and the low-COP consumed energy. Here, the standard consumed energy is an energy that would have been consumed in a case assuming that the COP of the air conditioners 10*a* and 10*e* had been a predetermined value (specifically, the rated COP) in the time when the air conditioners 10*a* and 10*e* were operating at a COP equal to or less than a predetermined value (specifically, equal to or less than ½ of the rated COP). That is, the standard consumed energy is an ideal energy in a case where an operation with poor efficiency was not performed. In other words, the standard consumed energy is a consumed energy in a case where the COP of the air conditioners 10*a* and 10*e* was an ideal value. The predetermined value can also be the mean COP of the building overall in addition to being the rated COP.

Figure 11:
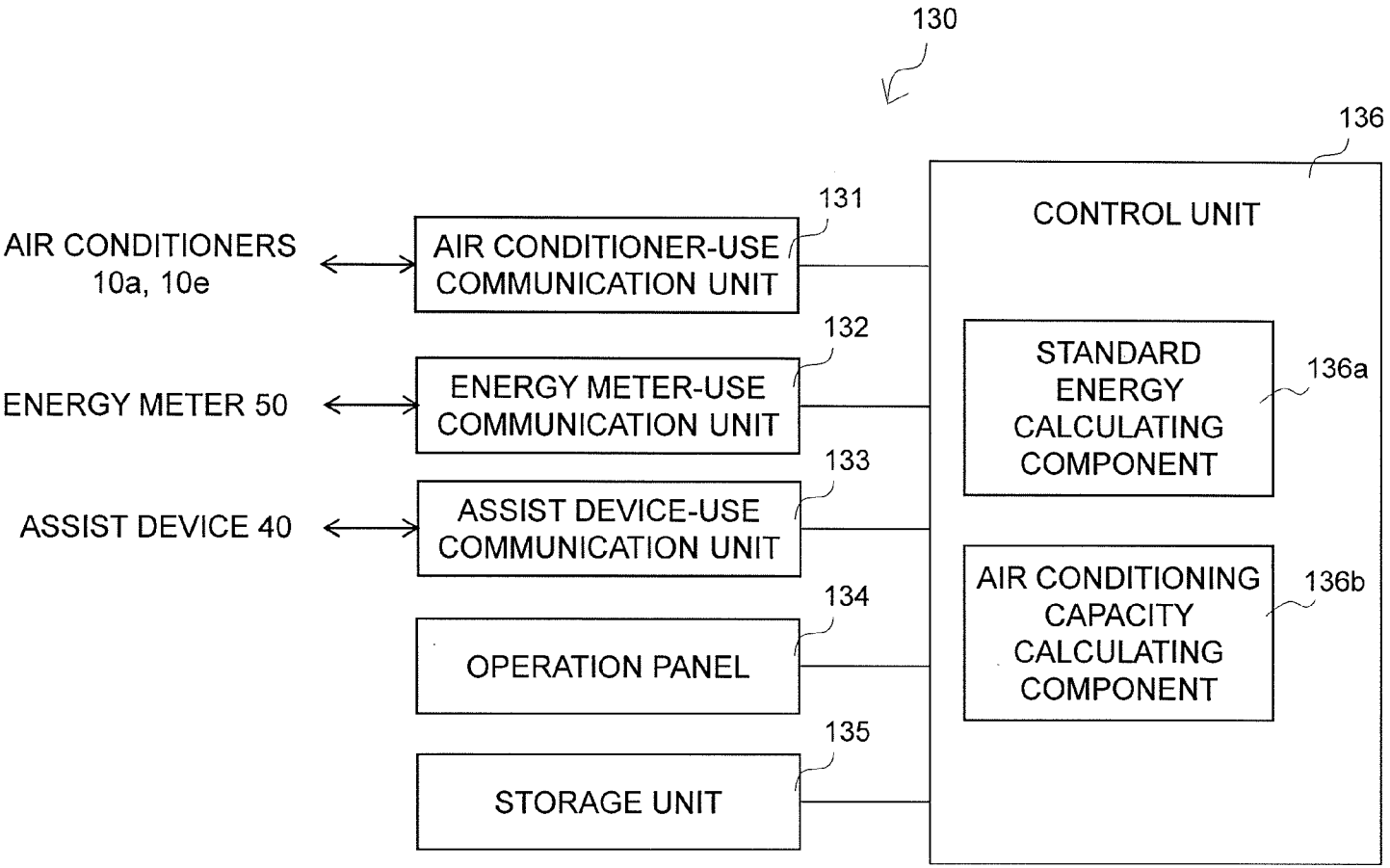
FIG. 11 is a diagram generally showing the internal configuration of a controller configuring part of an energy saving support device pertaining to another embodiment (d).

FIG. 11 shows the configuration of a controller 130 in this case. The controller 130 in FIG. 11 has an air conditioner-use communication unit 131, an energy meter-use communication unit 132, an assist device-use communication unit 133, an operation panel 134, a storage unit 135, and a control unit 136, and the control unit 136 functions as a standard energy calculating component 136*a* (which corresponds to the first energy calculating unit) and an air conditioning capacity calculating component 136*b*. The air conditioner-use communication unit 131, the energy meter-use communication unit 132, the assist device-use communication unit 133, the operation panel 134, the storage unit 135, and the air conditioning capacity calculating component 136*b* of the control unit 136 are respectively the same as the air conditioner-use communication unit 31, the energy meter-use communication unit 32, the assist device-use communication unit 33, the operation panel 34, the storage unit 35, and the air conditioning capacity calculating component 36*b* of the control unit 36 pertaining to FIG. 3 to which the same names were given in the above embodiment. The standard energy calculating component 136*a* calculates, on the basis of the operating data including the consumed energies of the air conditioners 10*a* and 10*e*, the standard consumed energy (which corresponds to a comparison target energy) of each of the air conditioners 10*a* and 10*e*. That is, the standard energy calculating component 136*a* obtains, on the basis of the operating data and regardless of the actual value of the COP, a theoretical value of the energy estimated to be consumed by each of the air conditioners 10*a* and 10*e* in a case assuming that the COP was equal to or less than ½ of the rated COP.

Other than the controller 130, the configuration of the energy saving support device (that is, the assist device 40) is the same as in the above embodiment, so detailed description thereof will be omitted.

Figure 12:
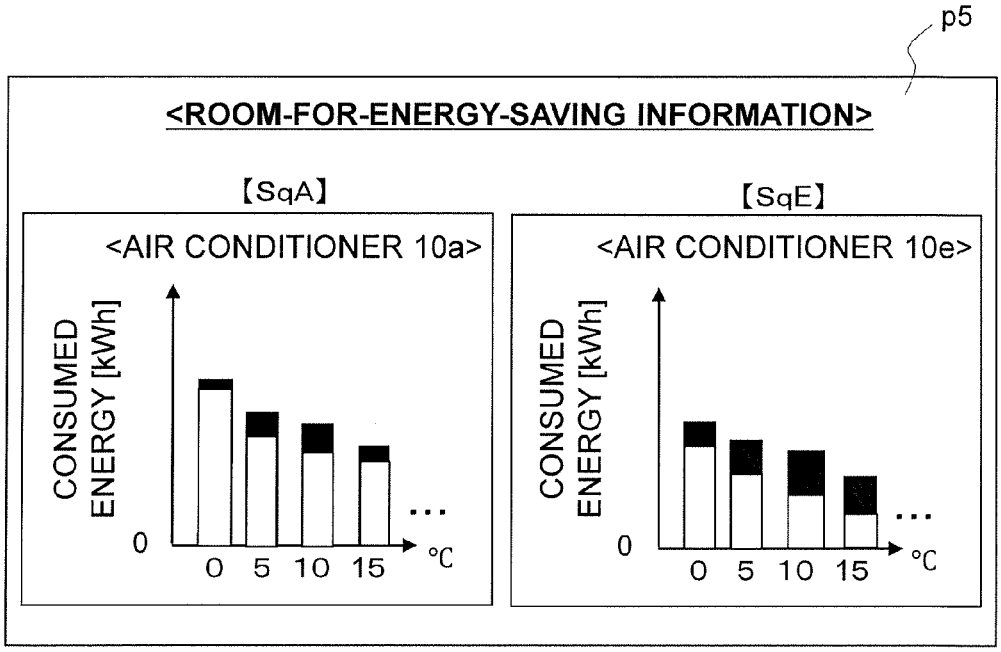
FIG. 12 is an example of a screen of the room-for-energy-saving information pertaining to the other embodiment (d).

In this case, FIG. 12 shows a screen p5 of the room-for-energy-saving information displayed on the display unit 42 of the assist device 40. In the screen p5 in FIG. 12, the standard consumed energy is shown in white and the difference between the standard consumed energy and the low-COP consumed energy is shown in black. In this case, the horizontal axis represents outside air temperature like in FIG. 10, and the COP is calculated in 5° C. intervals of outside air temperature.

According to this energy saving support device, the difference between the low-COP consumed energy that was actually consumed at a time when the air conditioners 10*a* and 10*e* were operating at a COP equal to or less than a predetermined value (equal to or less than ½ of the rated COP) and the energy (that is, the standard consumed energy) inferred to have been consumed if the COP had been the rated value at this time is reported as an index of room for energy saving. Because of this, the user can know to what extent the air conditioners 10*a* and 10*e* are performing an operation with poor efficiency, so the user can specifically grasp how much room there is in which consumed energy can be reduced.

(e)

In the above embodiment, a case where the room-for-energy-saving information is displayed as the proportion of the low-COP consumed energy with respect to the total consumed energy of the air conditioners has been described. However, the room-for-energy-saving information may also be displayed as the proportion of the actual COP with respect to the rated COP (called "the rated COP ratio" below). In a case where the rated COP ratio is smaller than 1, this means that the actual COP is lower than the rated COP, and in a case where the rated COP ratio is 1, this means that the actual COP is equivalent to the rated COP. Further, in a case where the rated COP ratio is larger than 1, this means that the actual COP is higher than the rated COP.

Figure 13:
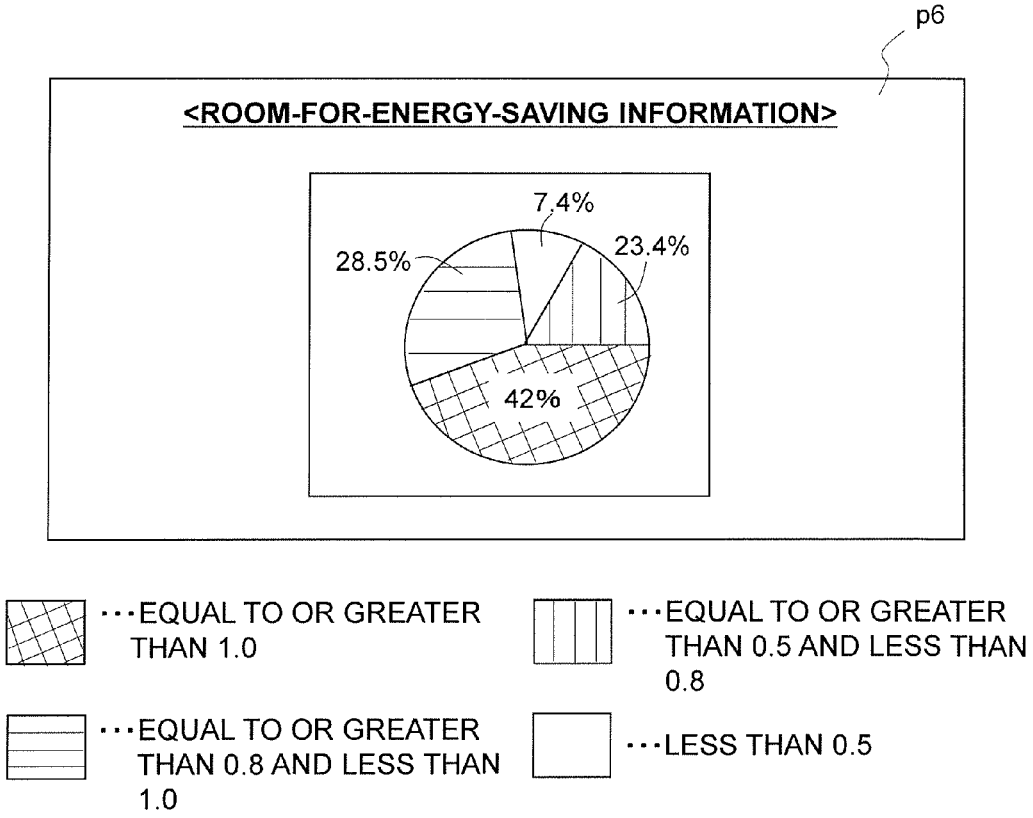
FIG. 13 is an example of a screen on which the room-for-energy-saving information is displayed as rated COP ratios in another embodiment (e).

FIG. 13 shows a screen p6 of the room-for-energy-saving information in this case. In FIG. 13, the rated COP ratio during one year in each of the air conditioners is shown as a percent in regard to four cases: a case where the rated COP ratio is equal to or greater than 1.0, a case where the rated COP ratio is equal to or greater than 0.8 and less than 1.0, a case where the rated COP ratio is equal to or greater than 0.5 and less than 0.8, and a case where the rated COP ratio is less than 0.5. The screen p6 shows one example of a case where two or more air conditioners are installed inside the building. According to this screen p6, the user can easily grasp how much energy each of the air conditioners 10*a* and 10*e* has consumed at times when it was operating at each COP.

Further, rather than being shown with the rated COP ratio being divided into multiple levels as described above, the room-for-energy-saving information pertaining to the present invention may also be displayed such that the power in the multiple COP ranges can be compared.

(f)

Figure 14:
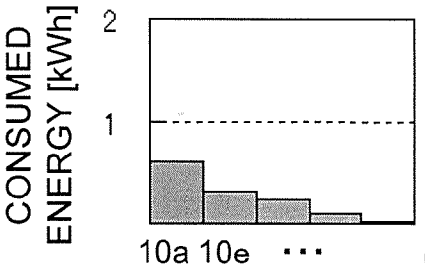
FIGS. 14(*a*) and (*b*) are examples of screens of the room-for-energy-saving information pertaining to another embodiment (f) and are diagrams showing cases where the room-for-energy-saving information is displayed in a graph.
Figure 14:
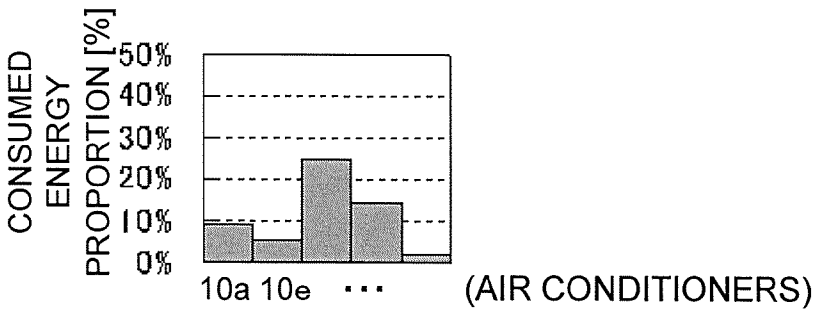

In the above embodiment, as shown in FIG. 6, a case where the room-for-energy-saving information of each of the air conditioners 10*a* and 10*e* was displayed in separate graphs for each of the air conditioners 10*a* and 10*e* has been taken as an example and described. However, as shown in FIGS. 14(*a*) and (*b*), the room-for-energy-saving information may also be displayed in a graph whose horizontal axis represents the air conditioners and whose vertical axis represents consumed energy (kWh) or consumed energy proportion (%). That is, the room-for-energy-saving information of each of the air conditioners 10*a* and 10*e* may also be displayed in one graph.

Figures 15, 16:
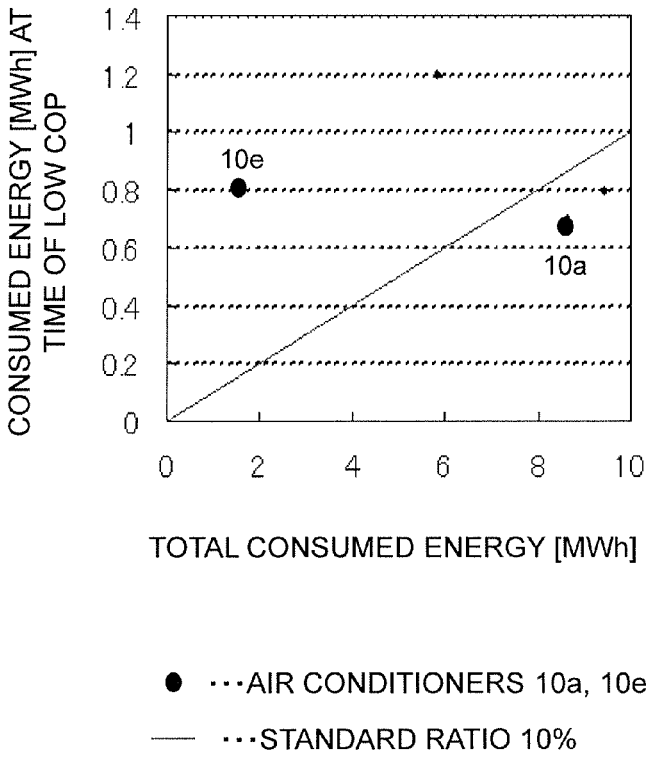
FIG. 15 is an example of a screen of the room-for-energy-saving information pertaining to the other embodiment (f) and is a diagram showing a case where the room-for-energy-saving information is displayed in a table.
FIG. 16 is an example of a screen of the room-for-energy-saving information pertaining to another embodiment (g) and is a diagram showing a case where the room-for-energy-saving information is displayed in a graph.

Further, the room-for-energy-saving information pertaining to FIGS. 14(*a*) and (*b*) may also be expressed in the form of a table as shown in FIG. 15.

FIGS. 14 and FIG. 15 show, like FIG. 13, one example of a case where two or more air conditioners are installed inside the building.

(g)

Moreover, as shown in FIG. 16, the room-for-energy-saving information may also be displayed in a form by which it can be understood how many air conditioners there are in which the low-COP consumed energy was equal to or greater than 10% of the total consumed energy. In FIG. 16, the horizontal axis represents the total consumed energy, the vertical axis represents the low-COP consumed energy, dots represent the consumed energy of each air conditioner, and a line represents 10% of the total consumed energy of each of the air conditioners 10*a* and 10*e*. From FIG. 16, it will be understood that the only air conditioner in which the total consumed energy was equal to or greater than 10% was the air conditioner 10*e*.

Figures 17, 18:
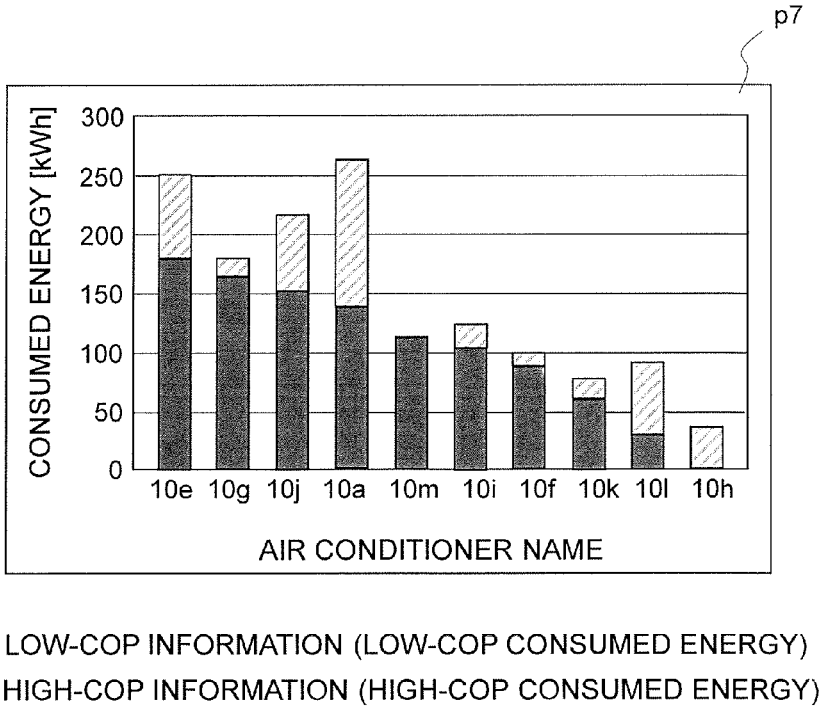
FIG. 17 is an example of a screen of the room-for-energy-saving information pertaining to the other embodiment (g) and is a diagram showing a case where the room-for-energy-saving information is displayed in a table.
FIG. 18 is an example of a screen of the room-for-energy-saving information pertaining to another embodiment (h) and is a diagram showing a case where the room-for-energy-saving information of multiple air conditioners is displayed in one graph and as an absolute quantity of consumed energy.

Further, FIG. 17 shows FIG. 16 in the form of a table. According to FIG. 17, it will be understood that the proportion of the low-COP consumed energy was a maximum (53.3%) in the air conditioner 10*e*.

FIG. 16 and FIG. 17 show a case where there are two air conditioners in accordance with the above embodiment, but with the forms of FIG. 16 and FIG. 17, even when the number of air conditioners is greater than this, an air conditioner in which the total consumed energy is equal to or greater than 10% can be easily grasped.

(h)

Next, an example of a display of the room-for-energy-saving information in a case where the number of air conditioners installed is equal to more than two will be described.

A screen p7 in FIG. 18 shows the room-for-energy-saving information displayed on the display unit 42 of the energy saving support device 20 in a case where ten air conditioners 10*a*, 10*e*, 10*f*, 10*g*, 10*h*, 10*i*, 10*j*, 10*k*, 10*l*, and 10*m* are installed inside the energy saving support system. In the screen p7, the horizontal axis represents the names 10*a* to 10*m* of each of the air conditioners, the vertical axis represents consumed energy (kWh), and the room-for-energy-saving information of each of the air conditioners 10*a* to 10*m* is displayed in one graph like in FIG. 14. However, whereas FIG. 14 show only the low-COP consumed energy of each of the air conditioners 10*a* and 10*e* as the room-for-energy-saving information, the screen p7 in FIG. 18 shows the room-for-energy-saving information of each of the air conditioners 10*a* to 10*m* as the absolute quantity of the total consumed energy and the absolute quantity of the low-COP consumed energy of each of the air conditioners 10*a* to 10*m*. Moreover, in the screen p7 in FIG. 18, the room-for-energy-saving information is shown in order beginning with the room-for-energy-saving information in which the low-COP consumed energy is large. Specifically, in the screen p7, the room-for-energy-saving information of the air conditioner 10*e* with the largest low-COP consumed energy is positioned on the far left, and the room-for-energy-saving information of the air conditioner 10*h* with the smallest low-COP consumed energy is positioned on the far right.

According to the display method shown in FIG. 18, the user can know at once from one graph which air conditioner of all of the air conditioners 10*a* to 10*m* has extremely poor efficiency and so forth. Consequently, the user can easily judge beginning with which of the air conditioners 10*a* to 10*m* an energy-saving measure would best be performed in order.

Further, the portion of the total consumed energy of each of the air conditioners 10*a* to 10*m* that is not the low-COP consumed energy—that is, a high-COP consumed energy—is shown with a different color or a pattern from that of the low-COP consumed energy. The high-COP consumed energy is an energy that the air conditioners 10*a* to 10*m* consumed at a time when they were operating at a COP equal to or greater than a predetermined value. That is, the room-for-energy-saving information pertaining to FIG. 18 includes low-COP information representing the absolute quantity of the low-COP consumed energy and high-COP information representing the absolute quantity of the high-COP consumed energy, and the low-COP information and the high-COP information are displayed such that they are visually distinguishable from one another. The combined value of the low-COP consumed energy and the high-COP consumed energy in each of the air conditioners 10*a* to 10*m* is equivalent to the total consumed energy in each of the air conditioners 10*a* to 10*m*.

Figure 19:
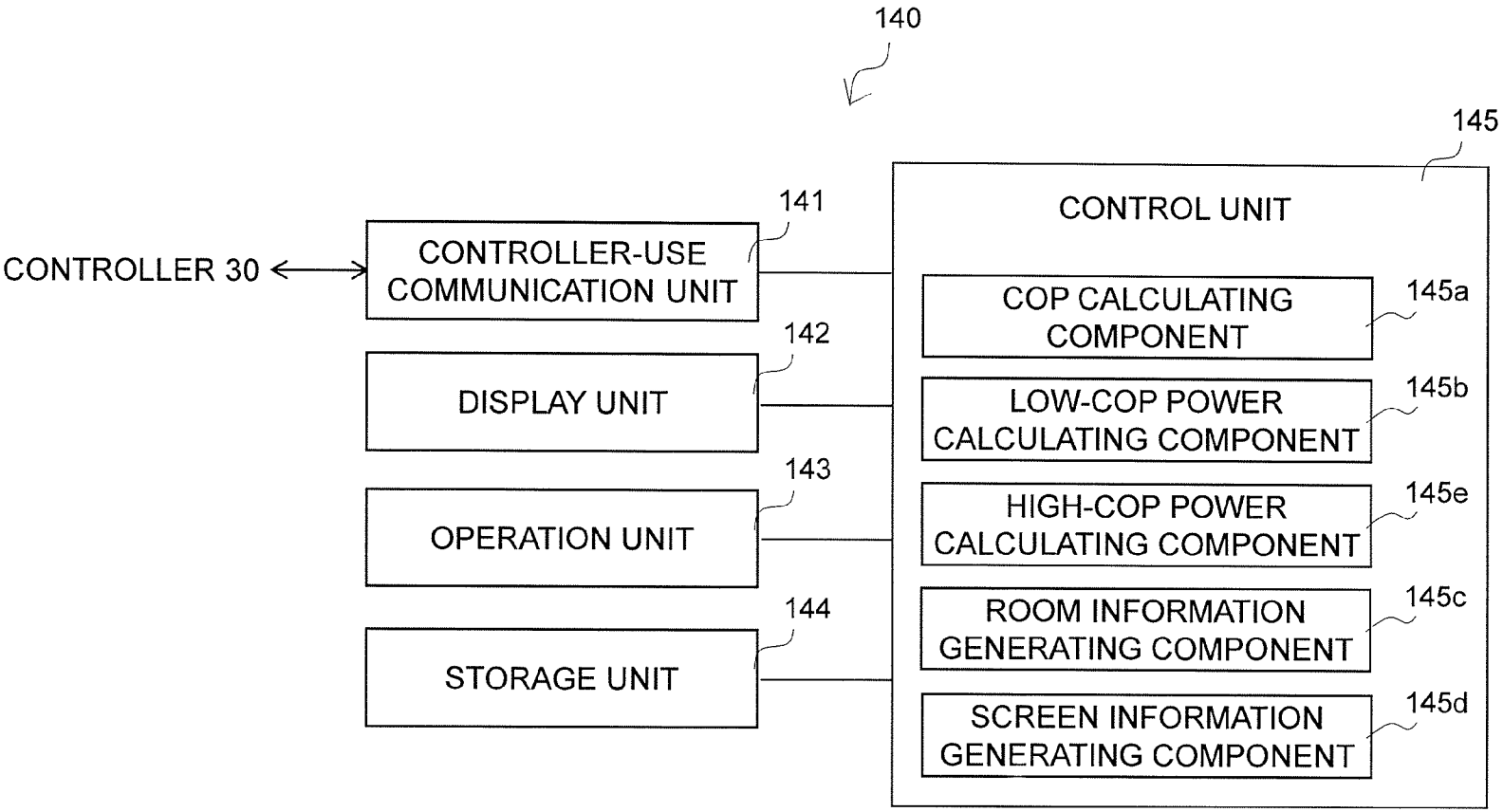
FIG. 19 is a diagram generally showing the internal configuration of an assist device configuring part of an energy saving support device pertaining to the other embodiment (h).

The high-COP consumed energy displayed in this way is calculated by a high-COP power calculating component 145*e* (which corresponds to a third energy calculating unit) shown in FIG. 19. The high-COP power calculating component 145*e* is, like a low-COP power calculating component 145*b*, one function of a control unit 145 and calculates the high-COP consumed energy on the basis of the operating data of each of the air conditioners 10*a* to 10*m* that a controller-use communication unit 141, for example, has received from the controller 30. Specifically, the high-COP power calculating component 145*e* extracts, from the total consumed energy Etl of each of the air conditioners 10*a* to 10*m* every predetermined period (for example, every one hour) calculated on the basis of the operating data by the total energy calculating component 36*a* of the controller 30, the total consumed energy Etl in a case where the COP of each of the air conditioners 10*a* to 10*m* obtained by a COP calculating component 145*a* is equal to or greater than ½ (which corresponds to a predetermined value) of the rated COP and calculates this as the high-COP consumed energy. Further, as another method of calculating the high-COP consumed energy, the high-COP calculating component 145*e* may also obtain the high-COP consumed energy by subtracting, from the total consumed energy Etl of each of the air conditioners 10*a* to 10*m* obtained by the total energy calculating component 36*a*, the low-COP consumed energy obtained by the low-COP power calculating component 145*e*.

Here, FIG. 19 is a configuration diagram of an assist device 140 equipped with the control unit 145 also functioning as the high-COP power calculating component 145*b*. The assist device 140 in FIG. 19 has a controller-use communication unit 141, a display unit 142, an operation unit 143, a storage unit 144, and a control unit 145, and the control unit 145 functions as the COP calculating component 145*a*, the low-COP power calculating component 145*b*, a room information generating component 145*c*, a screen information generating component 145*d*, and the high-COP power calculating component 145*e*. The controller-use communication unit 141, the display unit 142, the operation unit 143, the storage unit 144, and the COP calculating component 145*a*, the low-COP power calculating component 145*b*, the room information generating component 145*c*, and the screen information generating component 145*d* of the control unit 145 are respectively the same as the controller-use communication unit 41, the display unit 42, the operation unit 43, the storage unit 44, and the COP calculating component 45*a*, the low-COP power calculating component 45*b*, the room information generating component 45*c*, and the screen information generating component 45*d* of the control unit 45 pertaining to FIG. 5 to which the same names were given in the above embodiment. In particular, the room information generating component 145*c* in this case generates the room-for-energy-saving information of each of the air conditioners 10*a* to 10*m* shown in FIG. 18 on the basis of not only the low-COP consumed energy but also the high-COP consumed energy. In the case of FIG. 18, the room information generating component 145*c* generates the room-for-energy-saving information for each of the air conditioners 10*a* to 10*m* using the absolute quantity of the low-COP consumed energy as the low-COP information, the absolute quantity of the high-COP consumed energy as the high-COP information, and information including these pieces of information as the room-for-energy-saving information.

Other than the assist device 140, the configuration of the energy saving support device (that is, the controller 30) is the same as in the above embodiment, so detailed description thereof will be omitted.

In this way, the low-COP information and the high-COP information are displayed such that they are visually distinguishable by color or pattern, so the user can not only know the air conditioner that is performing an operation with poor efficiency but can also know the air conditioner that is performing an operation with good efficiency, and the user can instantly and easily know the good and bad of the efficiency of the operation of each of the air conditioners 10*a* to 10*m* is good or poor.

In the above description, a case where the room-for-energy-saving information includes two pieces of information—the low-COP information that is the absolute quantity of the low-COP consumed energy and the high-COP information that is the absolute quantity of the high-COP consumed energy—has been described. However, the room-for-energy-saving information may also include, for example, middle-COP information that is an absolute quantity of a middle-COP consumed energy in addition to the above two pieces of information. That is, the room-for-energy-saving information may also be configured by information classified into three or more pieces of information. In this case, the low-COP consumed energy is the consumed energy at a time when the COP is equal to or less than a first predetermined value, the middle-COP consumed energy is the consumed energy at a time when the COP is equal to or greater than the first predetermined value and equal to or less than a second predetermined value, and the high-COP consumed energy is the consumed energy at a time when the COP is equal to or greater than the second predetermined value. The second predetermined value is a value higher than the first predetermined value.

(i)

In FIG. 18, a case where the low-COP information is the absolute quantity of the total consumed energy and where the high-COP information is the absolute quantity of the high-COP consumed energy has been described. However, as shown in a screen p8 in FIG. 20, the low-COP information may also be information in which the proportion of the low-COP consumed energy with respect to the total consumed energy is expressed as a percent, and the high-COP information may also be information in which the proportion of the high-COP consumed energy with respect to the total consumed energy is expressed as a percent. The user can set accordance to preference whether to express the room-for-energy-saving information comprising the low-COP information and the high-COP information in absolute quantities like in FIG. 18 or in relative quantities like in FIG. 20. FIG. 21 shows a screen p9 for setting whether to express the room-for-energy-saving information in absolute quantities or in relative quantities. This screen p9 is displayed before the room-for-energy-saving information shown in FIG. 18 or FIG. 20 is displayed on the display unit 42.

Figure 20:
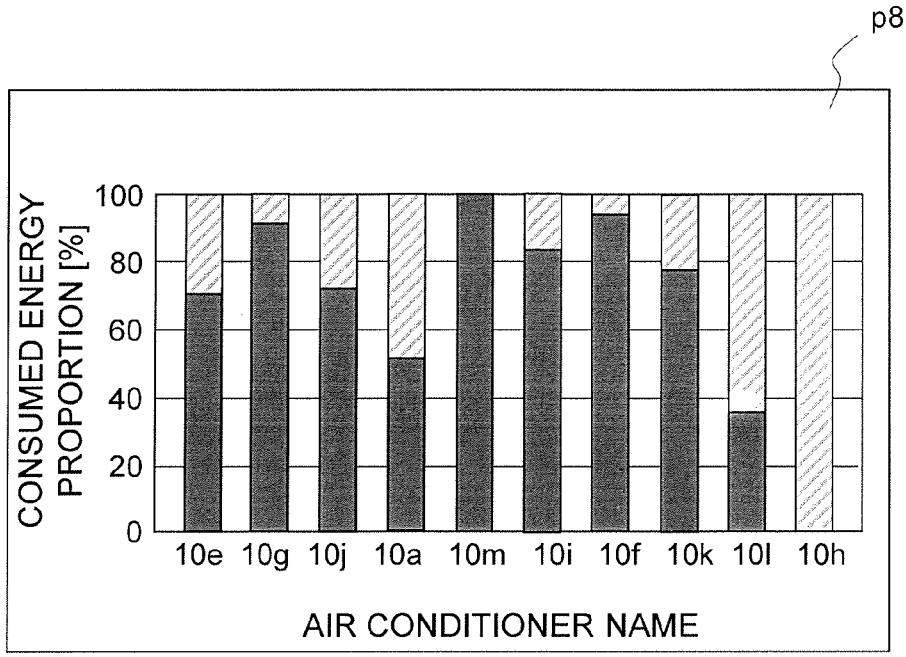
FIG. 20 is an example of a screen of the room-for-energy-saving information pertaining to another embodiment (i) and is a diagram showing a case where the room-for-energy-saving information of the multiple air conditioners is displayed in one graph and as a relative quantity of consumed energy.
Figure 21:
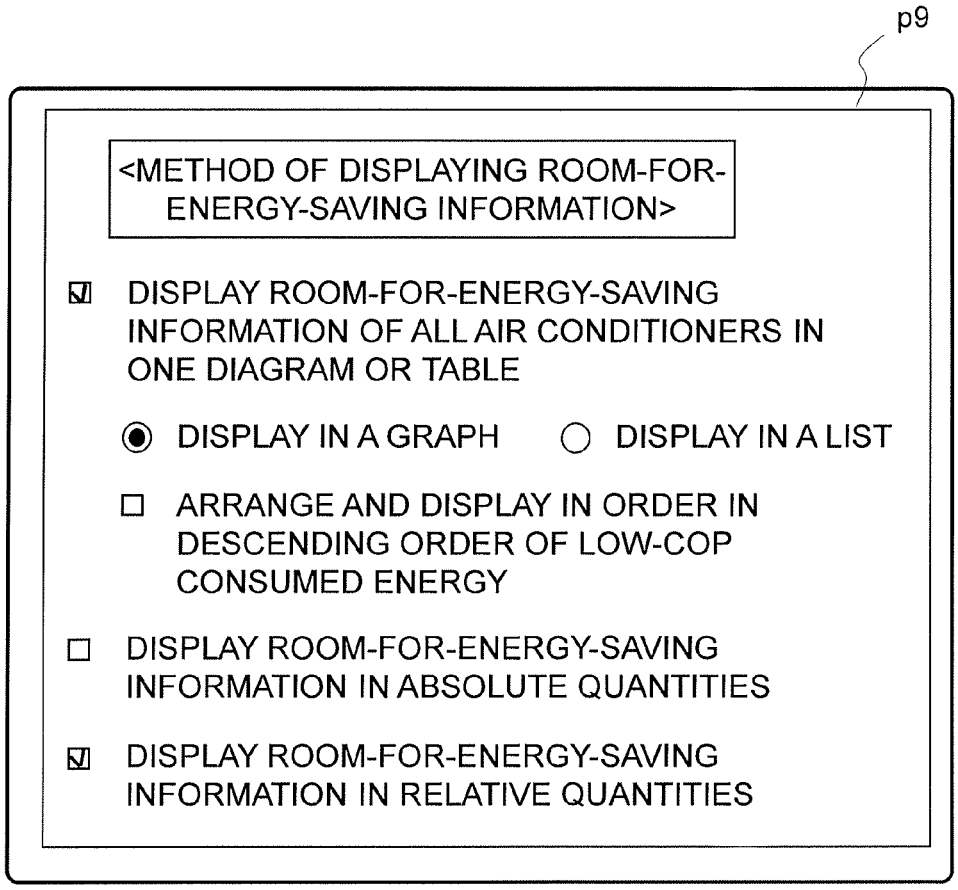
FIG. 21 is a screen for setting a method of displaying the room-for-energy-saving information.

Moreover, because of the screen p9 in FIG. 21, the user can set whether to display the room-for-energy-saving information of all of the air conditioners 10*a* to 10*m* in one diagram or table like in FIGS. 18, 20, and 22. Specifically, when "Display in a graph" pertaining to the screen p9 in FIG. 21 is selected by the user, the display unit 42 can display the room-for-energy-saving information of all of the air conditioners 10*a* to 10*m* in a graph as shown in FIGS. 18 and 20, and when "Display in a list" is selected by the user, the display unit 42 can display the room-for-energy-saving information of all of the air conditioners 10*a* to 10*m* in a list as shown in FIG. 22. Further, from the screen p9, the user can set whether to arrange and display the room-for-energy-saving information of all of the air conditioners 10*a* to 10*m* in descending order of the low-COP consumed energy as shown in FIGS. 18, 20, and 22 or arrange and display the room-for-energy-saving information of all of the air conditioners 10*a* to 10*m* according to the installation locations or the names of the air conditioners 10*a* to 10*m* regardless of the low-COP consumed energies.

FIG. 22 shows a screen p10 in which the room-for-energy-saving information of all of the air conditioners 10*a* to 10*m* displayed on one graph in FIG. 18 is displayed as one list. In the screen p10, the air conditioner names of all of the air conditioners 10*a* to 10*m*, their installation locations, the absolute quantities of their low-COP consumed energies, and the absolute quantities of their total consumed energies are corresponded with each other as one record. The absolute quantities of the low-COP consumed energies and the absolute quantities of the total consumed energies pertaining to the screen p10 are the room-for-energy-saving information and are arranged and displayed in the screen p10 as the above record in order beginning with the air conditioners 10*e*, 10*g*, etc. in which the absolute quantity of the low-COP consumed energy is large.

(j)

Figure 23:
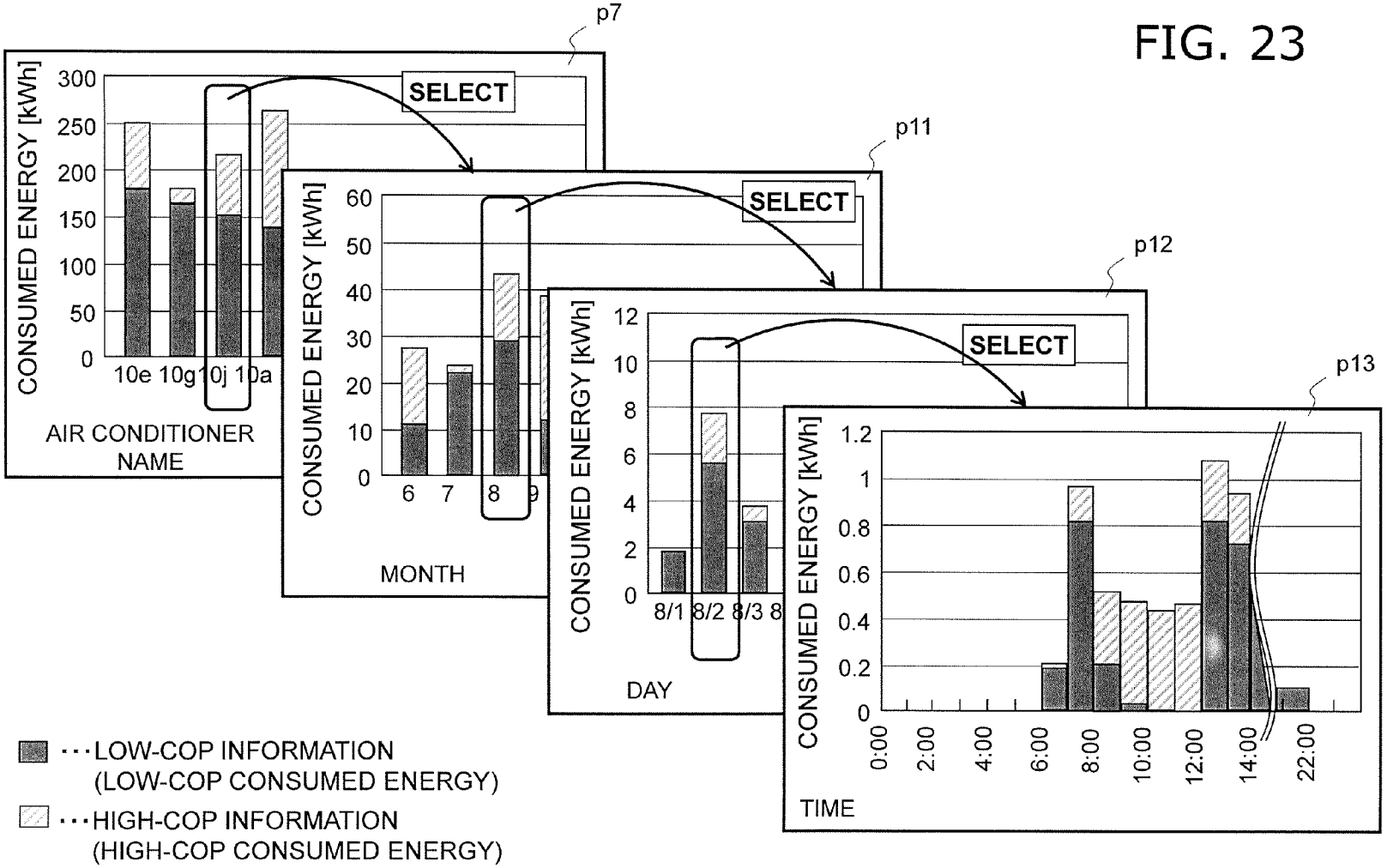
FIG. 23 is an example of screens of the room-for-energy-saving information pertaining to another embodiment (j) and is a diagram showing a case where the absolute quantity of the total consumed energy and the absolute quantity of the low-COP consumed energy of an air conditioner corresponding to selected room-for-energy-saving information are displayed in a time series.

Further, the room-for-energy-saving information on each of the screens p7, p8, and p10 in FIGS. 18, 20, and 22 may also be selectably displayed. FIG. 23 is a drawing in which the graphs showing the room-for-energy-saving information of each of the air conditioners 10*a* to 10*m* in the screen p7 in FIG. 18 are selectably displayed and which shows a screen p11 and so forth that are displayed in a case where an arbitrary graph has been selected from the screen p7. For example, let it be assumed that the graph representing the room-for-energy-saving information of the air conditioner 10*j* (that is, the air conditioner name "10*j*") has been selected in the screen p7. In this case, the absolute quantity of the low-COP consumed energy and the absolute quantity of the total consumed energy regarding the selected air conditioner 10*j* are displayed in a time series (see screens p11, 12, and 13 in FIG. 23).

This will be specifically described below. Let it be assumed that, in FIG. 18, the total consumed energy and the low-COP consumed energy of each of the air conditioners 10*a* to 10*m* respectively represent an integrated value per each of the air conditioners 10*a* to 10*m* of the consumed energy consumed during one year and an integrated value (an integrated value of the low-COP consumed energy per each of the air conditioners 10*a* to 10*m*) during one year of the energy consumed at a time when the air conditioner was operating at a COP equal to or less than a predetermined value. In FIG. 18, when the graph representing the room-for-energy-saving information of the air conditioner 10*j* is selected, as shown in the screen p11 in FIG. 23, first the absolute quantity of the total consumed energy and the absolute quantity of the low-COP consumed energy of the air conditioner 10*j* per month from January to December are displayed. That is, the screen p11 displays the room-for-energy-saving information of the air conditioner 10*j* per month. Moreover, each graph on the screen p11 is also selectable, and when the graph representing the room-for-energy-saving information of August is selected by the user, the screen p12 in FIG. 23 is displayed. On the screen p12, there are displayed graphs in which the absolute quantity of the total consumed energy and the absolute quantity of the low-COP consumed energy of the air conditioner 10*j* during August are shown per day. Each graph on screen p12 is also selectable, and when the graph representing the room-for-energy-saving information on August 2 is selected by the user, the screen p13 in FIG. 23 is displayed. On the screen p13, there are displayed graphs in which the hourly numerical values of the low-COP consumed energy and the absolute quantity of the total consumed energy of the air conditioner 10*j* on August 2 are shown.

That is, according to FIG. 23, when a graph representing the room-for-energy-saving information of an arbitrary air conditioner 10*a* to 10*m* is selected from the screen p7, detailed room-for-energy-saving information (specifically, the absolute quantity of the total consumed energy and the absolute quantity of the low-COP consumed energy) of the air conditioner 10*a* to 10*m* corresponding to the selected room-for-energy-saving information is displayed as fine data in chronological order. Because of this, the user can visually grasp in detail at what point in time an operation with poor efficiency was performed in the selected air conditioner 10*a* to 10*m*, so the user can take an appropriate measure for reducing consumed energy.

In the above description, as one example, a case where arbitrary room-for-energy-saving information was selected from the graphs pertaining to the screen p7 in FIG. 18 has been described. However, even in a case where arbitrary room-for-energy-saving information has been selected from the graphs pertaining to the screen p8 in FIG. 20 and the list pertaining to the screen p10 in FIG. 22, the absolute quantity of the total consumed energy and the absolute quantity of the low-COP consumed energy regarding the air conditioner 10*a* to 10*m* corresponding to the selected room-for-energy-saving information may also be displayed in a time series like in FIG. 23.

(k)

Here, a method of displaying the room-for-energy-saving information in a case where the number of air conditioners installed is even larger than in the above mentioned other embodiments (h) to (j) will be described using FIG. 24. Below, a case where the number of air conditioners installed is 100 or more will be taken as an example.

Figure 24:
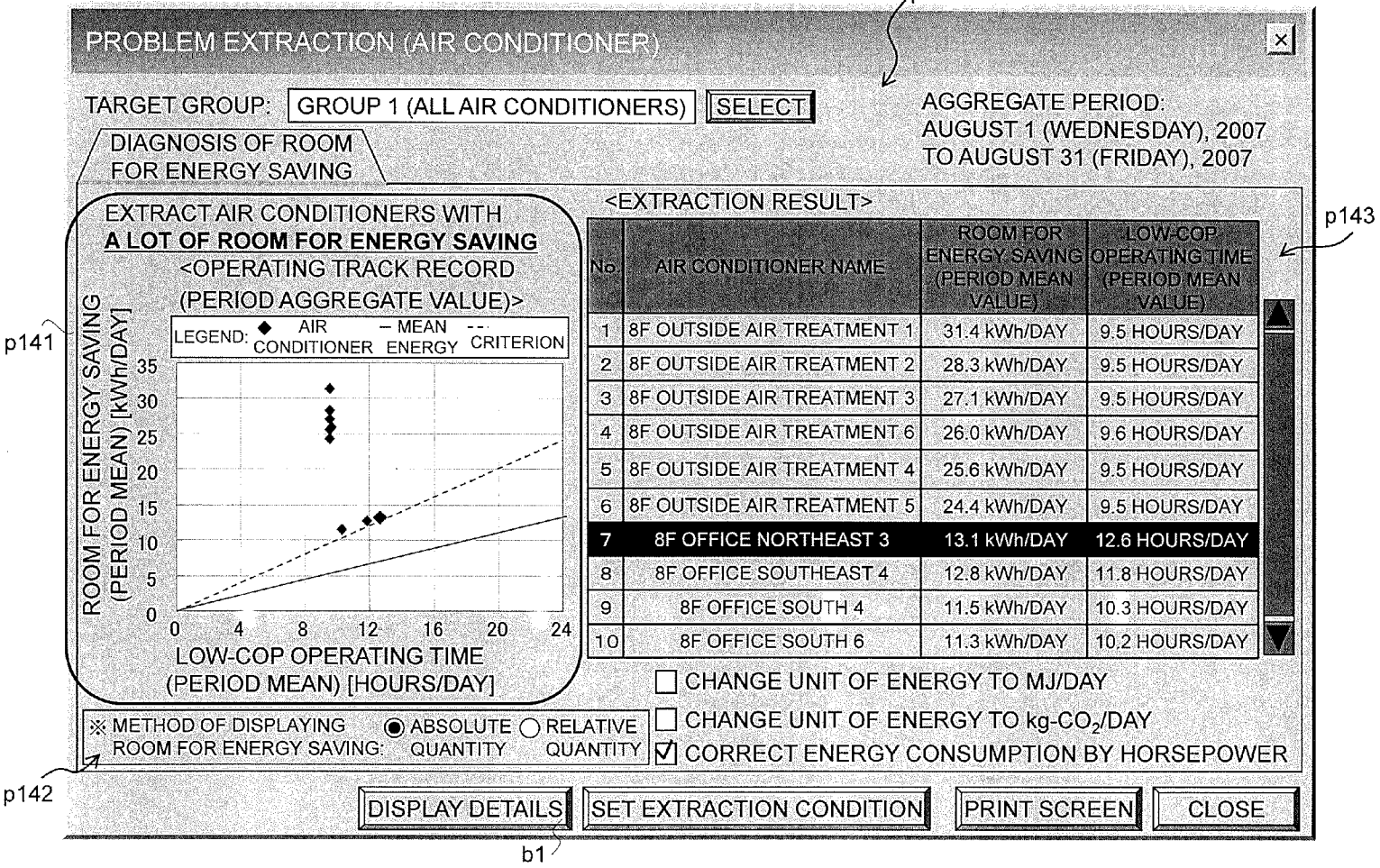
FIG. 24 is an example of a screen of the room-for-energy-saving information pertaining to another embodiment (k) and is an example of a screen of the room-for-energy-saving information displayed on a display unit in a case where about 100 air conditioners are installed.

A screen p14 in FIG. 24 has a distribution chart p141 showing the room-for-energy-saving information of each of the air conditioners and information p142 for the user to set whether to display the room-for-energy-saving information in absolute quantities or in relative quantities. In the distribution chart p141, the horizontal axis represents the mean time per day of operating time at a low COP, the vertical axis represents the mean value of the low-COP consumed energy per day (in FIG. 24, this is displayed as "Room for Energy Saving (Period Mean)"), and the dots represent the room-for-energy-saving information of each of the air conditioners during one month from August 1 to August 31 (aggregate period). The solid line in the distribution chart p141 represents a result obtained by averaging the combined value of the low-COP consumed energies of all of the air conditioners per low-COP operating time, and the dashed line represents a criterion for judging that there is room for energy saving. From FIG. 24, the user can know how many air conditioners in which there is room for energy saving there are even when the number of air conditioners is large.

In the distribution chart p141, the horizontal axis and the vertical axis respectively represent the mean value per day of the low-COP operating time and the mean value of the low-COP consumed energy per day, but the horizontal axis and the vertical axis may also respectively represent the integrated value of the low-COP operating time and the integrated value of the low-COP consumed energy in the aggregate period.

Moreover, in FIG. 24, a list p143 is displayed on the side of the distribution chart p141. The list p143 is linked to and displayed with the distribution chart p141, so that, for example, when an arbitrary record is selected in the list p143, the room-for-energy-saving information on the distribution chart p141 of the air conditioner corresponding to the selected record is displayed in a different color from that of the other room-for-energy-saving information. When a "display details" button b1 is pressed in this state, the room-for-energy-saving information of the selected air conditioner may also be displayed in a time series as shown in the screens p11 to p13 in FIG. 23.

(l)

FIGS. 18 and 20 showed a case where the room-for-energy-saving information includes the low-COP information relating to the low-COP consumed energy and the high-COP information relating to the high-COP consumed energy. However, the room-for-energy-saving information that is displayed may also be just the low-COP information or just the high-COP information. The energy saving support device applied in this case is configured by the assist device 140 pertaining to FIG. 19 described in the other embodiment (h) and the controller 30 pertaining to FIG. 3 or the controller 130 pertaining to FIG. 11.

Figure 25:
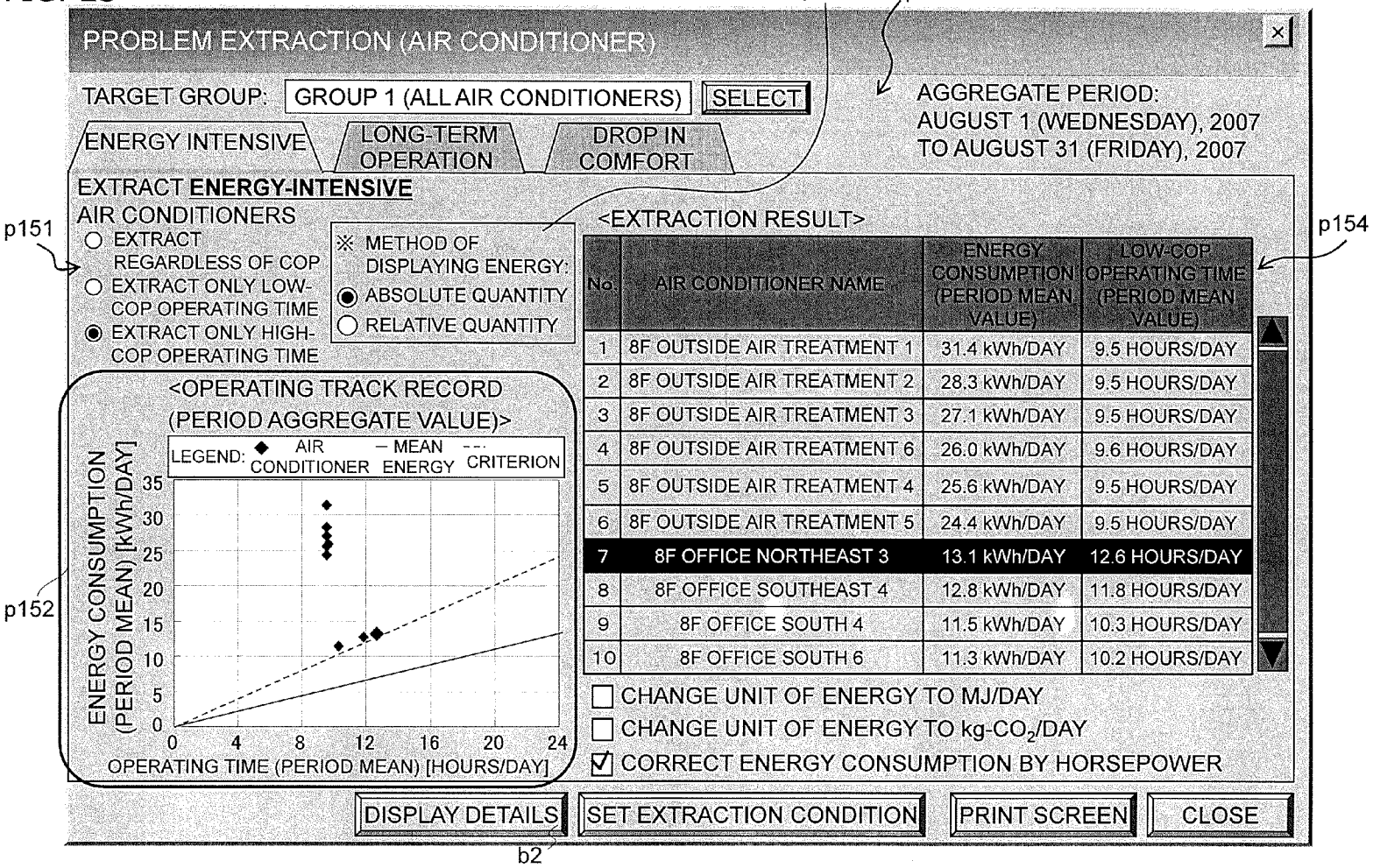
FIG. 25 is an example of a screen of the room-for-energy-saving information pertaining to another embodiment (l) and is a diagram showing a screen that has display selection information for selecting either high-COP information or low-COP information and a distribution chart in which the room-for-energy-saving information of the air conditioners is displayed.

A screen p15 pertaining to FIG. 25 has display selection information p151 for selecting which of the low-COP information and the high-COP information to display, a distribution chart 152 showing the room-for-energy-saving information of each of the air conditioners, and information p153 for setting whether to display the room-for-energy-saving information in absolute quantities or relative quantities. In FIG. 25, "Extract only high-COP operating time" is selected in the display selection information p151, so display of the high-COP information is selected, and on the distribution chart p152, only the high-COP information of the room-for-energy-saving information (that is, the absolute value of the high-COP consumed energy of each of the air conditioners, etc.) is displayed. In the distribution chart p152 at this time, the horizontal axis represents the mean value per day of operating time at a high COP, the vertical axis represents the mean time per day of the high-COP consumed energy (in FIG. 25, this is displayed as "Energy Consumption (Period Mean)"), and the dots represent the room-for-energy-saving information (only the high-COP information) of each of the air conditioners in one month from August 1 to August 31 (aggregate period). The solid line in the distribution chart p152 represents a result obtained by averaging the combined value of the high-COP consumed energies of all of the air conditioners per high-COP operating time, and the dashed line represents a criterion for judging that it is alright not to save energy or that it becomes a reference (model) of energy saving. From FIG. 25, the user can know, even when the number of air conditioners is large, how many air conditioners there are in which it is alright not to perform energy saving or which become a reference (model) of energy saving.

In a case where "Extract only low-COP operating time" has been selected in the display selection information p151, only the low-COP information (that is, the absolute value of the low-COP consumed energy of each of the air conditioners, etc.) of the room-for-energy-saving information is displayed. In this case, the horizontal axis and the vertical axis are the same as in FIG. 24.

Because of this display selection information p151, the user can switch between extracting either the low-COP information or the high-COP information and displaying it as the room-for-energy-saving information. That is, the user can set which of the low-COP information and the high-COP information to display according to preference and object.

Moreover, in FIG. 25, a list p154 is displayed on the side of the distribution chart p152. The list p154 is linked to and displayed with the distribution chart p152, so that, for example, when an arbitrary record is selected in the list p154, the room-for-energy-saving information on the distribution chart p152 of the air conditioner corresponding to the selected record is displayed in a different color from that of the other room-for-energy-saving information. When a "display details" button b2 is pressed in this state, the room-for-energy-saving information of the selected air conditioner may also be displayed in a time series as shown in the screens p11 to p13 in FIG. 23 and/or various parameters such as the evaporating temperature and the condensing temperature regarding the selected air conditioner and schedule information representing what kind of operation (operating state such as set temperature, humidity, heating and cooling) the air conditioner performed at the time when it performed the high-COP operation may also be displayed.

(m)

In the above embodiment, a case where only the low-COP consumed energy is obtained has been described, and in the other embodiments (h) and so forth, a case where the low-COP consumed energy and the high-COP consumed energy are obtained has been described. However, the energy saving support device pertaining to the present invention may also obtain only the high-COP consumed energy on the basis of the operating data of each of the air conditioners. In this case, the assist device that is one of the components of the energy saving support device takes a configuration in which the low-COP power calculating component **145*b* in FIG. 19** is not disposed.

Because of this, the user can know the air conditioners that are performing an operation with good efficiency. Further, the user can also judge that there is room for energy saving in air conditioners other than the air conditioners that are performing an operation with good efficiency.

(n)

In the above embodiment, as shown in FIG. 1, a case where the air conditioners **10*a* and 10*e*** are so-called split-type air conditioners has been described, but the air conditioner type is not limited to this. For example, the air conditioners may also be so-called separate-type air conditioners where one indoor unit is connected to one outdoor unit. In this case, the energy saving support device pertaining to the present invention is connected to each indoor unit or each outdoor unit and can display the room-for-energy-saving information regarding each air conditioner.

(o)

In the above embodiment, as shown in FIG. 2, a case where an air conditioner of one system is installed per one room has been described. That is, in the above embodiment, a case where the air conditioner 10*a* comprising the one outdoor unit 11*a* and the four indoor units 12*a* to 12*d* is installed inside the one room SqA and where the air conditioner 10*e* comprising the one outdoor unit 11*e* and the four indoor units 12*e* to 12*h* is installed inside the one room SqE has been described. However, the energy saving support device pertaining to the present invention can also be applied to a case where air conditioners of multiple systems are installed inside one room (that is, inside one air conditioning target space).

In this case, the air conditioner-use communication unit and the energy meter-use communication unit (which correspond to the acquiring unit) of the energy saving support device acquire the operating data from each of the multiple air conditioners installed inside the one room, and the control unit functioning as the room information generating component generates the room-for-energy-saving information in regard to each air conditioner. According to this energy saving support device, the user can know the room for energy saving in each air conditioner inside the one room and can take measures to reduce consumed energy while considering the temperature inside the room and airflow balance.

(p)

In the above embodiment, a case where the room-for-energy-saving information is displayed on the display unit 42 of the assist device 40 in the energy saving support device 20 has been described. However, it suffices for the room-for-energy-saving information to be reported to the user; for example, the room-for-energy-saving information may also be reported to the user by an audio announcement or by a combination of audio and display.

Further, the energy saving support device 20 may also output the room-for-energy-saving information to another device separate from the energy saving support device 20 rather than displaying it on the display unit 42. For example, the energy saving support device 20 may transmit the room-for-energy-saving information via email to a terminal that each user individually carries or output the room-for-energy-saving information to a printer.

(q)

In the above embodiment, a case where the actions of integrating the energy and estimating the air conditioning capacity are performed every one hour has been described. However, the interval of time in which the actions of integrating the energy and estimating the air conditioning capacity is not limited to one hour, and these actions may also be performed every 24 hours, for example. In a case where the operating data change over 24 hours, the action of estimating the air conditioning capacity may be appropriately performed on the basis of the operating data, and the mean value of the estimation results at the times of estimation may be decided as the air conditioning capacity of one day.

(r)

Figure 7:
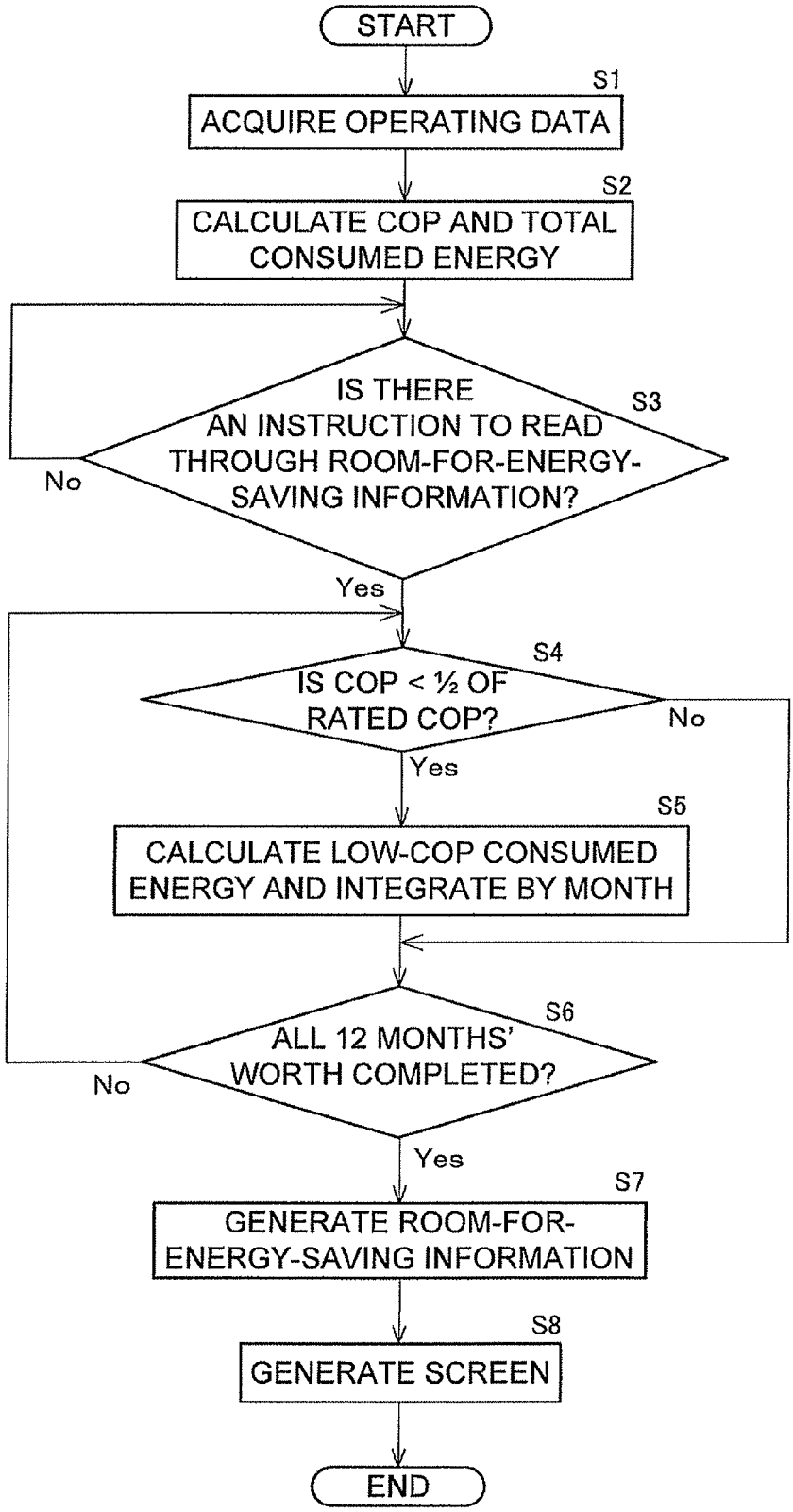
FIG. 7 is a flowchart for describing a series of actions by the energy saving support device pertaining to the embodiment.

In the above embodiment, as shown in FIG. 7, a case where 12 months' worth of the room-for-energy-saving information is displayed by month has been described. However, the unit and quantity in which the room-for-energy-saving information is displayed are not limited to this. For example, one month's worth of the room-for-energy-saving information may also be displayed by day.

(s)

In the above embodiment, a case where the COP calculating component 45*a* calculates the system COP of each of the air conditioners 10*a* and 10*e* has been described. However, the COP calculating component may also calculate the unit COP of each of the air conditioners 10*a* and 10*e*. The unit COP is obtained by dividing the air conditioning capacity Q (specifically, Qc or Qh) of each of the air conditioners 10*a* and 10*e* calculated by the air conditioning capacity calculating component 36*b* with the total consumed energy Eo' of only the outdoor unit in each system (unit COP=Q/Eo').

Here, the total consumed energy Eo' used to calculate the unit COP is calculated by subtracting the energy consumed in all of the indoor fans in one system from the total consumed energy Eo of each of the outdoor units 11*a* and 11*e* (that is, the total consumed energy of all of the outdoor units in one system). Further, as a method other than this, there is a method of obtaining the total consumed energy Eo' by multiplying the operating time by the rated power of the indoor fan in regard to all of the indoor fans in one system and subtracting all of the multiplication results from the total consumed energy Eo of each of the outdoor units 11*a* and 11*e* (that is, the total consumed energy of all of the outdoor units in one system). Moreover, in a case where it is possible to measure the energy of only the outdoor units 11*a* and 11*e* excluding the energy consumed in all of the indoor fans in one system, the COP calculating component may also calculate the unit COP using the directly measured results.

Further, in the above embodiment, as a method of calculating the system COP, a method of dividing each air conditioning capacity Q by the total consumed energy Etl in each of the air conditioners 10*a* and 10*e* has been described. However, the method of calculating the system COP is not limited to this. Other examples of methods of calculating the system COP may include a method of multiplying the air conditioning capacity Q every one minute, for example, by the consumed energy similarly every one minute to first obtain the COP every one minute and then integrating one hour's worth of these values.

(t)

The low-COP power calculating component 45*b* pertaining to the above embodiment calculated, as the low-COP consumed energy, the total consumed energy in a case where the COP of each of the air conditioners 10*a* and 10*e* is equal to or less than ½ of the rated COP. However, the condition when deciding the low-COP consumed energy is not limited to this. For example, the low-COP power calculating component may also calculate, as the low-COP consumed energy, the total consumed energy in a case where the COP of each of the air conditioners 10*a* and 10*e* is equal to or less than ¾ of the rated COP or equal to or less than the rated COP. Moreover, the low-COP power calculating component may also calculate, as the low-COP consumed energy, the total consumed energy in a case where the COP of each of the air conditioners 10*a* and 10*e* is equal to or less than a targeted lower limit COP (for example, equal to or less than 2.0) regardless of the rated COP.

INDUSTRIAL APPLICABILITY

The energy saving support device pertaining to the present invention has the advantageous effect that a user can easily grasp air conditioners in which there is room for energy saving, and the energy saving support device pertaining to the present invention can be applied as a device for supporting energy saving of air conditioners.

What is claimed is:

1. An energy saving support device that supports energy saving of an air conditioner, the energy saving support device comprising:

a controller programmed to acquire operating data regarding the air conditioner;

determine a total consumed energy or a standard consumed energy of the air conditioner as a comparison target energy based on the operating data acquired;

determine a low-COP consumed energy based on the operating data acquired, the low-COP consumed energy being an energy that the air conditioner consumed at a time when operating at a COP equal to or less than a predetermined value;

generate room-for-energy-saving information in order to determine a potential for energy saving based on the comparison target energy and the low-COP consumed energy; and report the room-for-energy-saving information.

2. The energy saving support device according to claim 1, wherein the room-for-energy-saving information includes a proportion of the low-COP consumed energy with respect to the total consumed energy.

3. The energy saving support device according to claim 2, wherein the room-for-energy-saving information includes the low-COP consumed energy expressed as a percent in a case where the total consumed energy is 100%.

4. The energy saving support device according to claim 1, wherein the standard consumed energy is an energy that would have been consumed in a case assuming that the COP of the air conditioner had been a predetermined value in the time when the air conditioner was operating at a COP equal to or less than the predetermined value, and the room-for-energy-saving information includes a difference between the standard consumed energy and the low-COP consumed energy.

5. The energy saving support device according to claim 1, wherein the room-for-energy-saving information includes an absolute quantity of the total consumed energy and an absolute quantity of the low-COP consumed energy, and the controller is further programmed to display the room-for-energy-saving information such that the absolute quantity of the total consumed energy and the absolute quantity of the low-COP consumed energy relating to the air conditioner are visually determinable.

6. The energy saving support device according to claim 1, wherein the controller is further programmed to acquire, from a plurality of the air conditioners, operating data of each of the air conditioners, calculate the comparison target energy and the low-COP consumed energy for each of the air conditioners, generate the room-for-energy-saving information for each of the air conditioners, and comparably display the room-for-energy-saving information of each of the air conditioners.

7. The energy saving support device according to claim 6, wherein the controller is further programmed to display the room-for-energy-saving information of the plurality of the air conditioners inside one diagram or table in order beginning with the room-for-energy-saving information in which the low-COP consumed energy is largest.

8. The energy saving support device according to claim 6, wherein the controller is further programmed to selectably display the room-for-energy-saving information of the plurality of the air conditioners inside one diagram or table, and in a case where the room-for-energy-saving information has been selected, display in a time series an absolute quantity of the low-COP consumed energy and an absolute quantity of the total consumed energy regarding the air conditioner corresponding to the room-for-energy-saving information that has been selected.

9. The energy saving support device according to claim 6, wherein the controller is further programmed to acquire the operating data from the plurality of the air conditioners, and the plurality of air conditioners are installed inside one air conditioning target space.

10. The energy saving support device according to claim 1, wherein the controller is further programmed to display the room-for-energy-saving information together with information relating to date and time.

11. The energy saving support device according to claim 1, wherein the controller is further programmed to display the room-for-energy-saving information together with information relating to outside air temperature.

12. The energy saving support device according to claim 1, wherein the controller is further programmed to determine a high-COP consumed energy, the high-COP consumed energy being an energy that the air conditioner consumed at a time when it was operating at a COP equal to or greater than the predetermined value, and generate the room-for-energy-saving information based on the high-COP consumed energy.

13. The energy saving support device according to claim 12, wherein the room-for-energy-saving information includes low-COP information relating to the low-COP consumed energy and high-COP information relating to the high-COP consumed energy, and the controller is further programmed to display the low-COP information and the high-COP information such that the low-COP information and the high-COP information are visually distinguishable.

14. The energy saving support device according to claim 12, wherein the room-for-energy-saving information includes low-COP information relating to the low-COP consumed energy and high-COP information relating to the high-cop consumed energy, and the controller is further programmed to display display selection information usable in order to select which of the low-COP information and the high-COP information to display, display only the low-COP information of the room-for-energy-saving information in a case where display of the low-COP information has been selected using the display selection information, and display only the high-COP information of the room-for-energy-saving information in a case where display of the high-COP information has been selected using the display selection information.

15. An energy saving support device that supports energy saving of an air conditioner, the energy saving support device comprising:

a controller programmed to acquire operating data regarding the air conditioner;

determine a total consumed energy or a standard consumed energy of the air conditioner as a comparison target energy based on the operating data acquired;

determine at least one of a high-COP consumed energy, which is an energy that the air conditioner consumed at a time when it was operating at a COP equal to or greater than a predetermined value and a low-COP consumed energy, which is an energy that the air conditioner consumed at a time when it was operating at a COP equal to or less than the predetermined value based on the operating data acquired;

generate room-for-energy-saving information in order to determine a potential for energy saving based on the determinations of total consumed energy or standard consumed energy, and the at least one of high-COP consumed energy and low-COP consumed energy; and report the room-for-energy-saving information.

* * * * *